US010321753B2

(12) United States Patent
Lee

(10) Patent No.: US 10,321,753 B2
(45) Date of Patent: Jun. 18, 2019

(54) STRESS CONTROL BRUSH

(71) Applicant: Te-Kung Lee, Taipei (TW)

(72) Inventor: Te-Kung Lee, Taipei (TW)

( * ) Notice: Subject to any disclaimer, the term of this patent is extended or adjusted under 35 U.S.C. 154(b) by 305 days.

(21) Appl. No.: 15/383,972

(22) Filed: Dec. 19, 2016

(65) Prior Publication Data

US 2017/0143109 A1 May 25, 2017

Related U.S. Application Data

(63) Continuation-in-part of application No. PCT/CN2016/076669, filed on Mar. 18, 2016.

(30) Foreign Application Priority Data

Apr. 2, 2015 (CN) ..... 2015 1 0153033

(51) Int. Cl.

| | |
|---|---|
| ***A46B 5/00*** | (2006.01) |
| ***A46B 9/04*** | (2006.01) |
| ***A46B 15/00*** | (2006.01) |

(52) U.S. Cl.

CPC ..... *A46B 5/0066* (2013.01); *A46B 5/0058* (2013.01); *A46B 5/0083* (2013.01); *A46B 9/04* (2013.01); *A46B 15/004* (2013.01); *A46B 2200/1066* (2013.01)

(58) Field of Classification Search

CPC ... A46B 5/0066; A46B 5/0058; A46B 5/0083; A46B 9/04; A46B 15/004; A46B 2200/1066

See application file for complete search history.

(56) References Cited

U.S. PATENT DOCUMENTS 6,327,734 B1 12/2001 Meginniss, III et al.

FOREIGN PATENT DOCUMENTS

| | | |
|---|---|---|
| CN | 102949001 A | 3/2013 |
| JP | 2001299451 A | 10/2001 |
| TW | 201138673 | 11/2011 |
| TW | 201400054 | 1/2014 |
| TW | M492666 | 1/2015 |
| WO | 0121035 | 3/2001 |
| WO | 2016155512 | 10/2016 |

OTHER PUBLICATIONS

State Intellectual Property Office of the People's Republic of China, "Office Action," issued in connection with Chinese Patent Application No. 201510153033.4, dated Jul. 4, 2017, 12 pages.

*Primary Examiner* — Shay Karls

(74) *Attorney, Agent, or Firm* — Hanley, Flight & Zimmerman, LLC

(57) ABSTRACT

A stress control brush includes a handle, a brush head, and a feedback component. The brush head is pivoted on the handle, and the brush head is pivotable relative to the handle in an angular range. The feedback component is installed between the handle and the brush head. The feedback component is resilient and has a protruding state and a breakdown-sunken state. The feedback component is pressed by the brush head and in the breakdown-sunken state when the brush head is pivoted relative to the handle, and a feedback is provided by the feedback component.

20 Claims, 17 Drawing Sheets

STRESS CONTROL BRUSH

CROSS-REFERENCE TO RELATED APPLICATIONS

This application is a continuation in part of International Application No. PCT/CN2016/076669 filed on Mar. 18, 2016, which is based upon and claims priority to Chinese Patent Application No. 201510153033.4 filed on Apr. 2, 2015, the entire contents of which are incorporated herein by reference.

TECHNICAL FIELD

The disclosure relates to a brush, more particular to a stress control brush.

BACKGROUND

Good teeth brushing habits help people to maintain oral hygiene and avoid tooth decay. In order to keep oral hygiene, people brush their teeth every day with a strong force hoping to prevent their teeth from decay. However, according to a report, researchers pointed out that when teeth are brushed too hard, the surface of the teeth and the gums is damaged, increasing the risk of having decay and periodontal disease.

WO international publication No. 01/21035 discloses a toothbrush which can automatically release excessive tooth brushing force. The brush head of said brush is pivoted on the handle, and two opposite ends of the flat elastic plate connect the brush head and the handle, respectively, so that the angle between the brush head and the handle is a fixed value. When the brushing force is over the predetermined force value, the elastic plate is bent and deformed so that the angle between the brush head and the handle is changed significantly. When the force is continuously applied on the toothbrush with the flat elastic plate, the angle between the brush head and the handle is changed more significantly so that the toothbrush cannot maintain the normal function of a toothbrush; therefore, the damage on the teeth and gums caused by excessive brushing force can be avoided.

U.S. Pat. No. 6,327,734 discloses a sensing and signaling system for tooth brushes which reminds the user that the force applied to the teeth has exceeded a critical value. The toothbrush includes a brush-head member and a dome member which is collapsible and recoverable. The brush-head member includes a striking element extended away from a rear surface of the brush-head member and in contact with a surface of the dome member. When stress from the brush-head member is applied on the teeth of the user, the brush-head member is moved toward the toothbrush and transfers the stress to the dome member by the striking member. When an excessive force is applied by the user to the brush-head against the teeth, the dome member is collapsed so that the brush-head is moved toward the toothbrush to remind the user. When the excessive force is removed, the dome member recovers to the original shape and pushes the brush-head member back to the original position.

Taiwan utility patent No. M492666 discloses a stress control brush, wherein the stress control brush uses feedback from the elastic plate to remind the user that the brushing force is over the predetermined force value. In the stress control brush, the elastic plate connects the brush head and the handle. When the brushing force is over the predetermined force value, the elastic plate is in the collapsed bending state, and the angle between the brush head and the handle is changed significantly so that the stress control brush cannot maintain the normal toothbrush function; therefore, the damage on the teeth and gums caused by the excessive brushing force can be avoided. The brush head has a limiting part, and the handle has a limiting part. When the elastic plate is in the collapsed bending state, the limit parts of the brush head and the handle abut against each other so as to restrict the bending curvature of the elastic plate.

Although the tooth brushes described above are capable of notifying users whether or not the stress applied to teeth during brushing hurts the teeth and gums, some problems still exist with these tooth brushes. The tooth brush disclosed in the WO international publication No. 01/21035 has a problem that when the stress exceeds a predetermined value, the angle between the brush head and the handle is changed significantly and is temporarily disabled, and the tooth brush could even generate a plastic deformation which makes the tooth brush disabled; moreover, the predetermined force, which causes the deformation of the tooth brush, and the actual trigger force, which causes the deformation of the toothbrush when users are brushing their teeth, are different each time. If users want to clean the particularly dirty parts of the teeth such as the residue between teeth, this toothbrush may not fulfill the users' demands of having to brush with a stronger force.

The tooth brush disclosed in U.S. Pat. No. 6,327,734 has complicated structures and mechanisms of force transfer, and the structure of said tooth brush is also complicated to assemble. When the toothbrush is in use, the complicated structure and the tiny interspaces cause the deformation trigger force of the brush could be different each time, and the residues and contaminants are easily kept inside the brush head which is hard to be clean up and hard to keep dry. Bacteria significantly grow when the environment is too humid and the residues and contaminants are kept in the brush head such that this brush easily becomes unclean and increases the possibility of inflection.

The stress control brush disclosed in Taiwan utility patent No. M492666 has an elastic plate having a slight bending state and a collapsed bending state when the stress control brush is in use. The difference between the elastic coefficient of the elastic plate in the slight bending state and the elastic coefficient of the elastic plate in the collapsed bending state is small, and some users may not be able to feel the force feedback generated by the elastic plate when using this stress control brush.

SUMMARY

An embodiment of the present disclosure provides a stress control brush including a handle, a brush head, and a feedback component. The brush head is pivoted on the handle, and the brush head is pivotable in an angular range relative to the handle. The feedback component is installed between the handle and the brush head. The feedback component is resilient and has a protruding state and a breakdown-sunken state. The feedback component is pressed by the brush head and in the breakdown-sunken state when the brush head is pivoted relative to the handle, and a feedback is provided by the feedback component.

BRIEF DESCRIPTION OF THE DRAWINGS

The present disclosure will become better understood from the detailed description given hereinbelow and the accompanying drawings which are given by way of illustration only and are not limitative of the present disclosure, and wherein.

DETAILED DESCRIPTION

Figure 1:
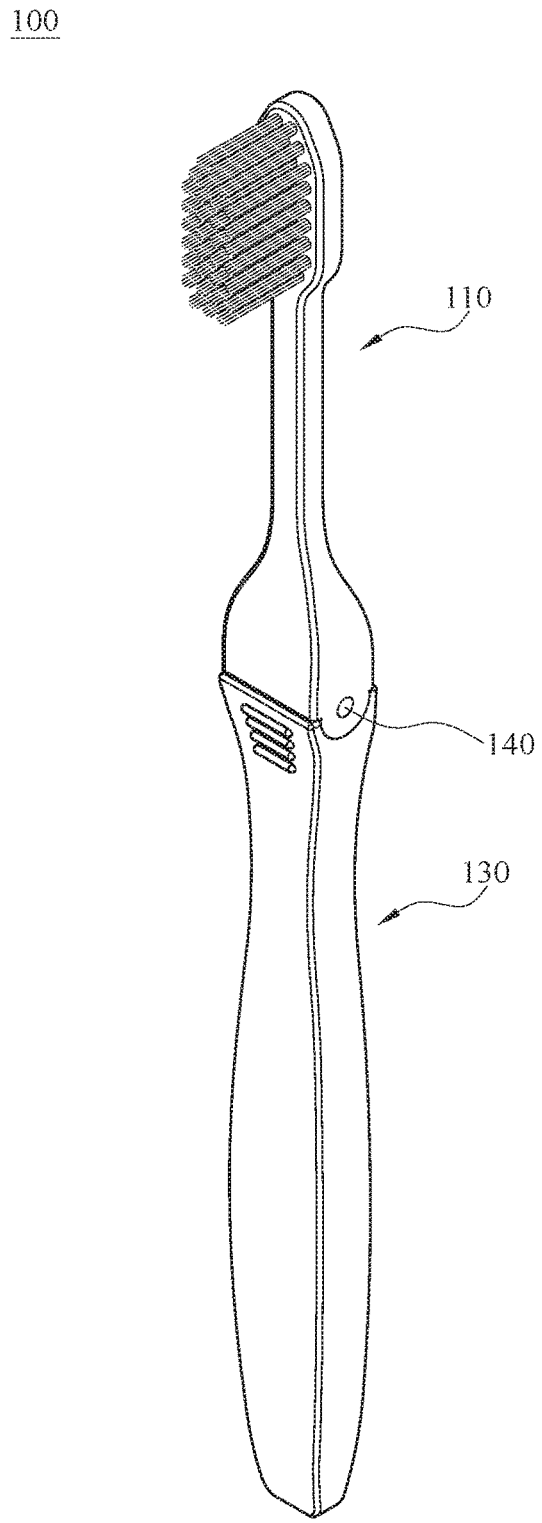
FIG. 1 is a schematic view of a stress control brush in a first embodiment of the present disclosure.
Figure 2:
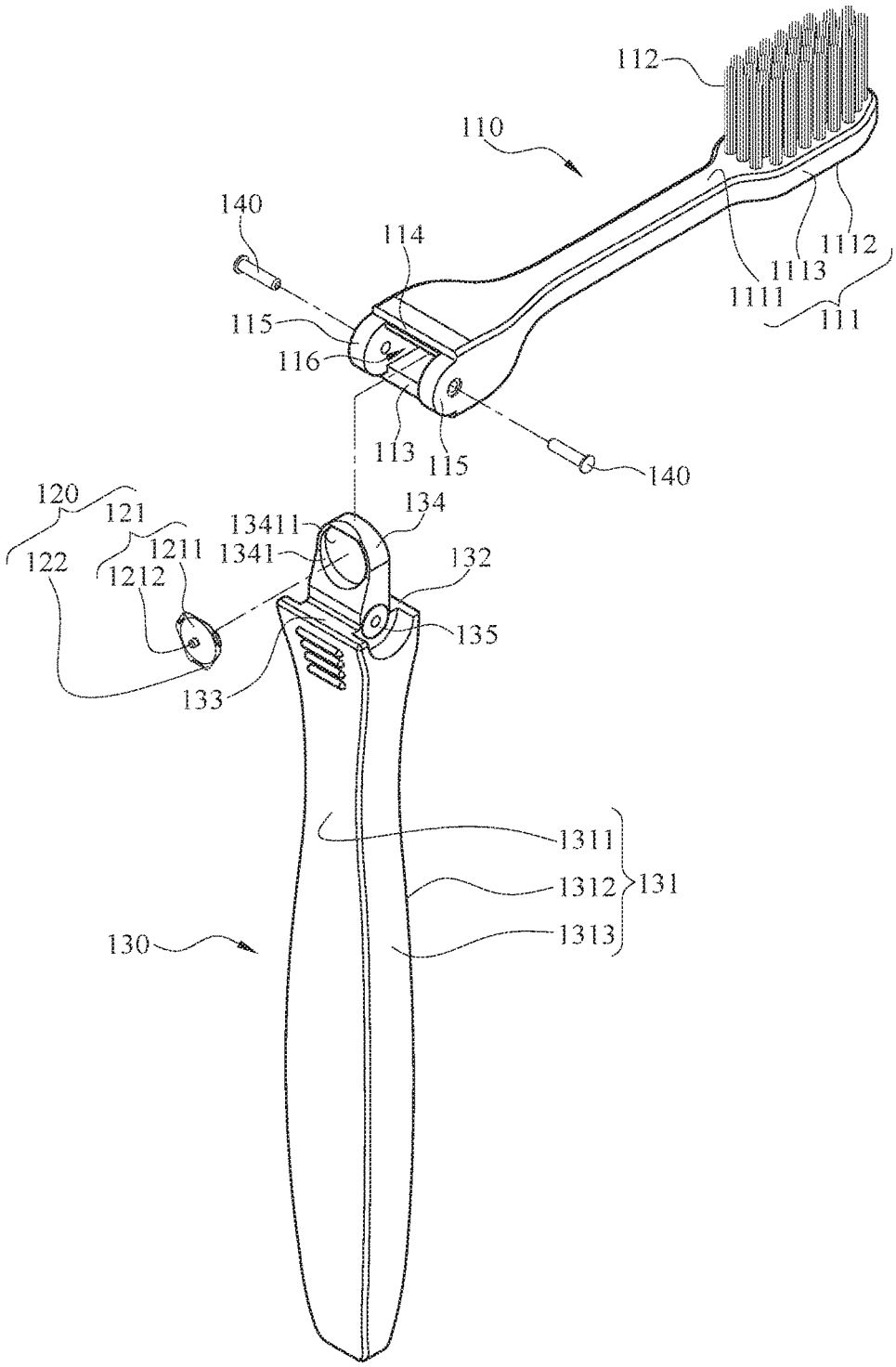
FIG. 2 is an exploded view of the stress control brush in the first embodiment of the present disclosure.
Figure 3A:
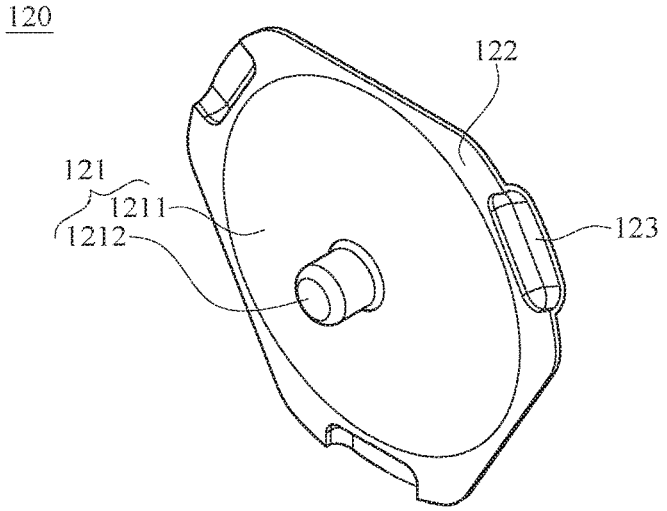
FIG. 3A is a schematic view of a first type feedback component in the first embodiment of the present disclosure.
Figure 3B:
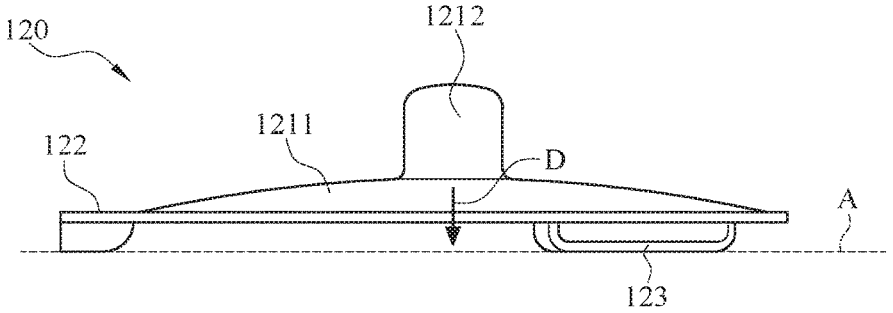
FIG. 3B is a side view of the first type feedback component in the first embodiment of the present disclosure.
Figure 3C:
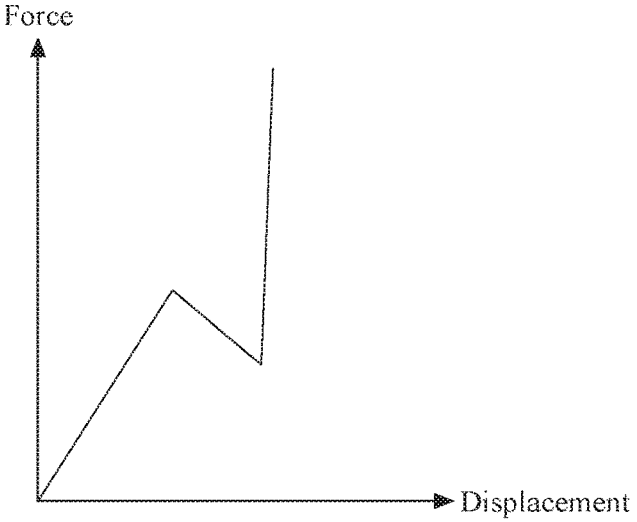
FIG. 3C is a schematic view of a force-displacement curve of the first type feedback component in the first embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing Please refer FIG. 1 to FIG. 3C. FIG. 1 is a schematic view of a stress control brush in a first embodiment of the present disclosure. FIG. 2 is an exploded view of the stress control brush in the first embodiment of the present disclosure. FIG. 3A is a schematic view of a first type feedback component in the first embodiment of the present disclosure. FIG. 3B is a side view of the first type feedback component in the first embodiment of the present disclosure. FIG. 3C is a schematic view of a force-displacement curve of the first type feedback component in the first embodiment of the present disclosure.

The stress control brush 100 in the first embodiment of the present disclosure includes a brush head 110, a feedback component 120, a handle 130, and a pivoting component 140. The brush head 110 includes a bristle seat 111, a plurality of bristle bundles 112, a first limit part 113, a first pressing part 114, and two first pivot parts 115. The bristle seat 111 has a front surface 1111 and a back surface 1112 which are opposite to each other, and two side surfaces 1113 located between the front surface 1111 and the back surface 1112. The plurality of bristle bundles 112 are installed at the front surface 1111. The back surface 1111 of the bristle seat 111 can further have a tongue cleaning part (not shown in the figures) for the user to clean the tongue.

The first limit part 113 is located at the back surface 1112 and extends toward a direction away from the bristle seat 111. The first pressing part 114, for example, is a pillar, and the first pressing part 114 is located at the front surface of the bristle seat 111 and extends toward a direction away from the bristle seat 111. In other embodiments of the present disclosure, the first limit part and the first pressing part can be two plates.

In the first embodiment of the present disclosure, the extending direction of the first limit part 113 and the extending direction of the first pressing part 114 are parallel to each other, but the disclosure is not limited thereto. In other embodiments of the present disclosure, the extending direction of the first limit part and the extending direction of the first pressing part form an angle not equal to zero. The two first pivot parts 115 are respectively located at the two side surfaces 1113, and there is a distance between the two first pivot parts 115. The first limit part 113, the first pressing part 114, and the two first pivot parts 115 together form an accommodating space 116.

In the first embodiment of the present disclosure, the bristle seat 111, the first limit part 113, the first pressing part 114, and the first pivot parts 115 are made of polymer, and the bristle seat 111, the first limit part 113, the first pressing part 114, and the two first pivot parts 115 are integratedly formed, but the disclosure is not limited thereto. In other embodiments of the present disclosure, the bristle seat, the first limit part, the first pressing part, and the two first pivot parts can be assembled or formed in one piece.

Please refer FIG. 3A to FIG. 3C, the feedback component 120, for example, is an elastic plate including a protrusion 121, a side part 122, and three sustaining parts 123. The protrusion 121 includes a first protrusion part 1211 and a second protrusion part 1212. The second protrusion part 1212 protrudes out of a surface of the first protrusion part 1211, wherein the first protrusion part 1211 and the second protrusion part 1212 have the same protruding direction, but the disclosure is not limited thereto. In other embodiments of the present disclosure, the first protrusion part 1211 and the second protrusion part 1212 have different protruding directions.

In other embodiments of the present disclosure, the first protrusion part and the second protrusion part have two opposite protruding directions. The side part 122 surrounds an edge of the first protrusion part 1211 so that the feedback component 120 has a disk structure; therefore, the feedback component 120 has a high elastic coefficient which is similar to a rigid body structure so that the first protrusion part 1211 can provide significant feedback, such as a sudden flexural movement, when the first protrusion part 1211 generates a sunken-deformation. The three sustaining parts 123 are located at the side part 122, and the three sustaining parts 123 have a protruding direction opposite to the protruding direction of the first protrusion part 1211 and the second protrusion part 1212. In the first embodiment of the present disclosure, the side part 122 surrounds the first protrusion part 1211, but the disclosure is not limited thereto. In other embodiments of the present disclosure, a part of the edge of the first protrusion part may not be surrounded by the side part. In the first embodiment of the present disclosure, the quantity of the sustaining parts 123 is three, but the disclosure is not limited thereto. In other embodiments of the present disclosure, the quantity of the sustaining parts can be less than three or more than three. In some embodiments of the present disclosure, the feedback component can be an elastic dome.

The first protrusion part 1211 is resilient and has a protruding state and a sunken state so that the feedback component 120 has a protruding state and a breakdown-sunken state. When the feedback component 120 is in the protruding state, a vertical distance which the second protrusion part 1212 moves toward a plane A where the sustaining parts 123 are located is D. When a force applied at a side of the first protrusion part 1211, which is close to the second protrusion part 1212, is smaller than a critical elastic force, and the deformation of the first protrusion part 1211 is still in the elastic limit, the first protrusion part 1211 is elastically deformed from the protruding state to the sunken state so that the moving distance D is increased. When the force applied on the first protrusion part 1211 is removed, the elastic force of the first protrusion part 1211 turns the first protrusion part 1211 from the sunken state back to the protruding state. As a result, when a force larger than the critical elastic force is applied at the second protrusion part 1212, the second protrusion part 1212 protruding from the first protrusion part 1211 turns the first protrusion part 1211 from the protruding state to the sunken state so that the feedback component 120 in the protruding state is turned to the breakdown-sunken state, and the moving distance D is significantly increased.

The handle 130 includes a grip 131, a second limit part 132, an auxiliary limiting part 133, a second pressing part 134, and a second pivot part 135. The grip 131 has a front surface 1311 and a back surface 1312 which are opposite to each other, and two side surfaces 1313 of the grip 131 which are opposite to each other and located between the front surface 1311 and the back surface 1312. The second limit part 132 is located at the back surface 1312 of the grip 131. The auxiliary limiting part 133 is located at the front surface 1311 of the grip 131. The second pivot part 135 connects the grip 131 and the second pressing part 134. In the first embodiment of the present disclosure, the second pressing part 134 is a protrusion on the grip 131, but the disclosure is not limited thereto. A side of the second pressing part 134 close to the front surface 1311 of the grip 131 has a recess 1341. The recess 1341 has a bottom surface 13411. In the first embodiment of the present disclosure, the grip 131, the second limit part 132, the auxiliary limiting part 133, the second pressing part 134, and the second pivot part 135 are made of polymer, and the grip 131, the second limit part 132, the auxiliary limiting part 133, the second pressing part 134, and the second pivot part 135 are integrally formed, but the disclosure is not limited thereto. In other embodiments of the present disclosure, the grip, the second limit part, the auxiliary limiting part, the second pressing part, and the second pivot part can be formed by assembling or in one piece.

The second pressing part 134 and the second pivot part 135 of the handle 130 are located in the accommodating space 116 of the brush head 110. The front surface 1311 of the grip 131 and the front surface 1111 face the same direction. The second pivot part 135 of the handle 130 is pivoted to the two first pivot parts 115 of the brush head 110 through the pivoting component 140 so that the brush head 110 can be pivot relative to the handle 130. As a result, the second pressing part 134 located in the accommodating space 116 can be relatively close to or away from the first pressing part 114. The feedback component 120 is located in the recess 1341. The sustaining parts 123 of the feedback component 120 are in contact with the bottom surface 13411 of the recess 1341 so that the first protrusion part 1211 keeps a distance from the bottom surface 13411. The first protrusion part 1211 and the second protrusion part 1212 of the feedback component 120 protrude toward a direction away from the bottom surface 13411, and the second protrusion part 1212 is in contact with a side of the first pressing part 114 facing the accommodating space 116.

When the brush head 110 pivots relative to the handle 130 so that a distance between the first pressing part 114 and the second pressing part 134 is changed, the first pressing part 114 presses the second protrusion part 1212 and further deforms the first protrusion part 1211, such as bring the first protrusion part 1211 to generate a sunken-deformation. Once a force over the critical force is applied at the first protrusion part 1211, the first protrusion part 1211 generates the sunken-deformation so that the feedback component 120 is in the breakdown-sunken state. By the design of the second protrusion part 1212 protruding out of the first protrusion part 1211, the first pressing part 114 constantly applies the force at the second protrusion part, which means the location of the first protrusion part 1211 being pressed is constant so that the critical elastic force which causes the sunken-deformation of the first protrusion part 1211 of the feedback component 120 to be close to a constant value each time, and therefore, the stress control effect of the stress control brush 100 is improved. In the first embodiment of the present disclosure, the protrusion 121 includes a first protrusion part 1211 and a second protrusion part 1212, but the disclosure is not limited thereto. In other embodiments of the present disclosure, the protrusion can include a first protrusion part where a concave region is located. The first pressing part can have a bulge corresponding to the concave region on the first protrusion part. When the brush head is pivoted relative to the handle, the bulge protruding out from the first pressing part can press the first protrusion part at the concave region and further bring the first protrusion part to generate a sunken-deformation.

The first limit part 113 extends from the bristle seat 111 toward the second limit part 132 of the handle 130. The first pressing part 114 extends from the bristle seat 111 toward the auxiliary limiting part 133 of the handle 130. In the first embodiment of the present disclosure, the first limit part 113 and the first pressing part 114 are pillars respectively extending from the brush head 110 toward the second limit part 132 and the auxiliary limiting part 133. The second limit part 132 and the auxiliary limiting part 133 are surfaces of the handle 130, but the disclosure is not limited thereto. In other embodiments of the present disclosure, the second limit part and the auxiliary limiting part are stop blocks protruding from the surface of the handle.

Figure 4A:
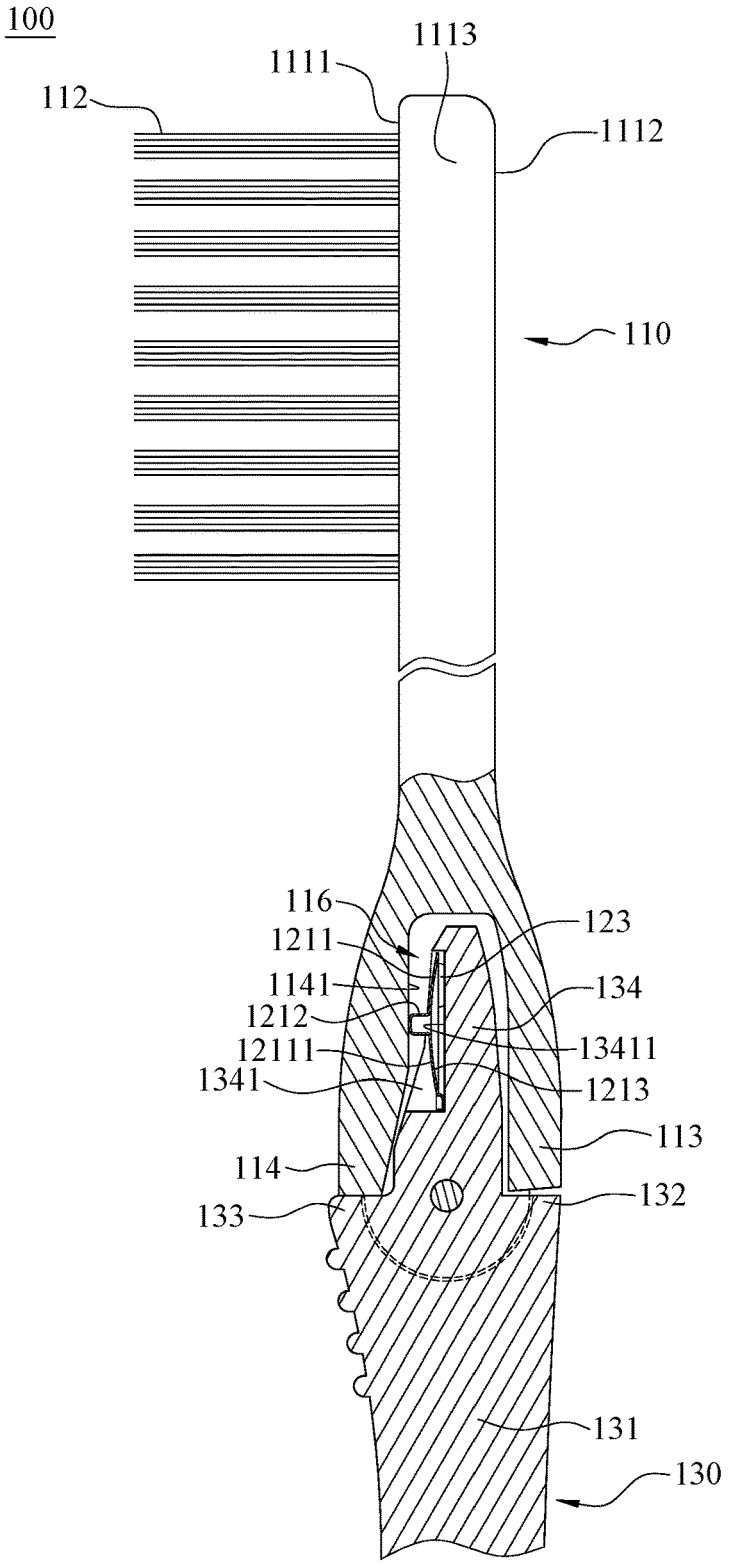
FIG. 4A and FIG. 4B are cross-sectional views of the stress control brush in the first embodiment of the present disclosure.
Figure 4B:
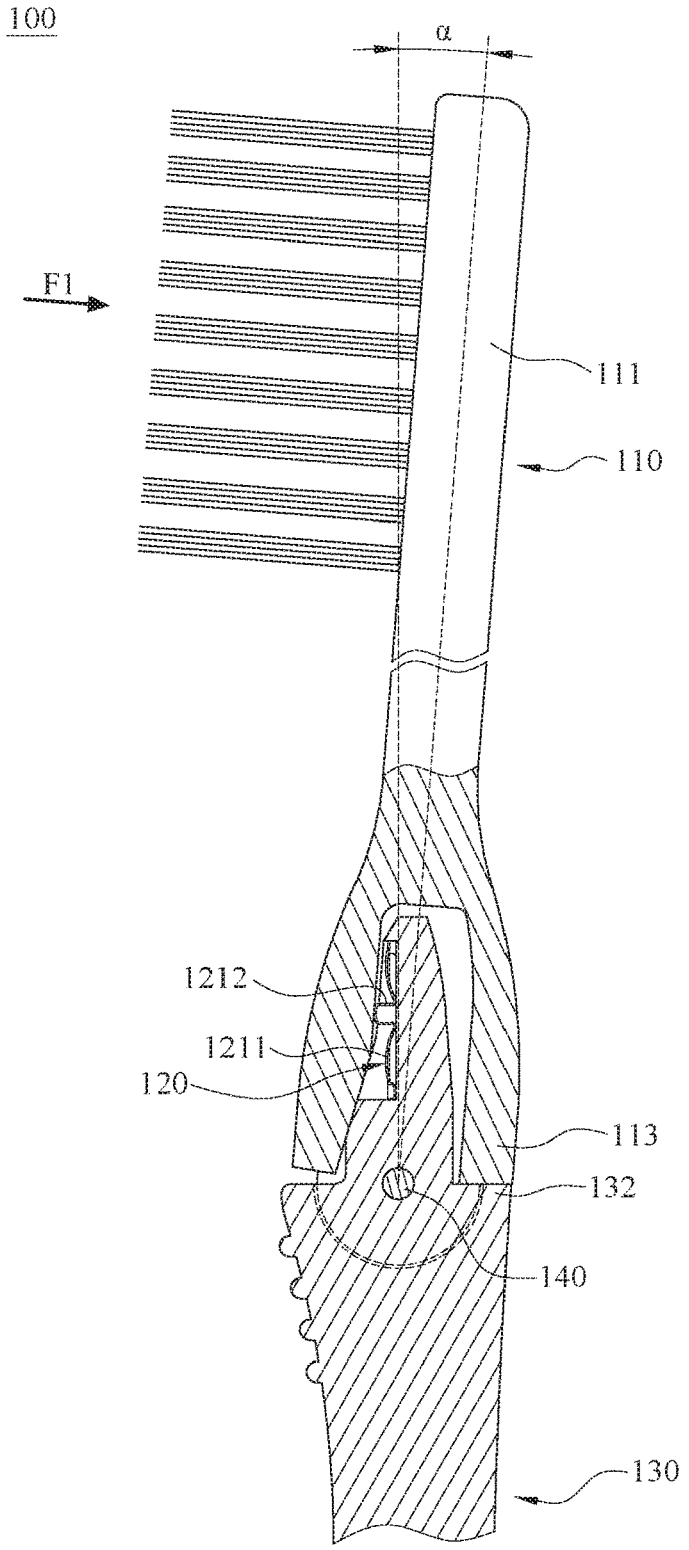

Please refer to FIG. 4A and FIG. 4B. FIG. 4A and FIG. 4B are cross-sectional views of the stress control brush in the first embodiment of the present disclosure. As shown in FIG. 4A, when the stress control brush 100 is in a non-using state, the brush head 110 bears no external force, and the feedback component 120 is in a protruding state. In detail, as shown in FIG. 4A, the handle 130 has the bottom surface 13411, the brush head 110 has a surface 1141 facing the bottom surface 13411 of the handle 130, the feedback component 120 is installed between the bottom surface 13411 and the surface 1141, the feedback component 120 has a convex surface 12111 and a concave surface 1213 opposite each other, the convex surface 12111 faces one of the bottom surface 13411 and the surface 1141, and the concave surface 1213 faces the other one of the bottom surface 13411 and the surface 1141. The first protrusion part 1211 of the protrusion 121 is at a protruding state so that the second protrusion part 1212 is in contact with the first pressing part 114. At this time, the first limit part 113 keeps a distance from the second limit part 132, and the first pressing part 114 and the auxiliary limiting part 133 are pressed against each other. As shown in FIG. 4B, when the user is brushing teeth, the teeth apply a counterforce (first force F1) to the central location of the plurality of bristle bundles on the bristle seat 111 so that the first force F1 takes the pivoting component 140 as a fulcrum to generate an applying-force torque relative to the handle 130. The elastic force of the first protrusion part 1211 of the feedback component 120 is applied to the first pressing part 114 through the second protrusion part 1212 so that the elastic force takes the pivoting component 140 as a fulcrum to generate a resistance torque relative to the handle 130. When the user uses a brushing force smaller or equal to the critical force to brush the teeth, the teeth and the gums are not damaged by the excessive brushing force. When the brushing force equal to the critical force is used, the elastic force of the feedback component 120, which achieves a torque equivalent with the brushing force, is the critical elastic force.

When the first force F1 is smaller than or equal to the critical force, the force applied on the feedback component 120 is smaller than or equal to the critical elastic force. Since the feedback component 120 has a high elastic coefficient similar to a rigid body, the first protrusion part 1211 generates a negligible deformation when bearing a force smaller than or equal to the critical elastic force. At this time, the feedback component 120 is in a slightly sunken-state, the brush head 110 is slightly pivoted relative to the handle 130, and the moving distance D of the second protrusion part 1212 toward the plane A (bottom surface 13411), where the sustaining parts 123 are located is only increased slightly. The resistance torque generated by the elastic force of the first protrusion part 1211 in the feedback component 120 is equal to the applying-force torque generated by the first force F1.

When the first force F1 is larger than the critical force, the force applied on the feedback component 120 is larger than the critical elastic force so that the structure of the first protrusion part 1211 of the feedback component 120 is collapsed and generates a significant sunken elastic deformation. At this time, the feedback component 120 is in the breakdown-sunken state, and the brush head 110 is significantly pivoted relative to the handle 130, the moving distance D of the second protrusion part 1212 toward the plane A (bottom surface 13411), where the sustaining parts 123 are located is significantly increased. The resistance torque generated by the elastic force of the first protrusion part 1211 of the feedback component 120 is smaller than the applying-force torque generated by the first force F1. The significant bending and deformation of the stress control brush 100 makes the stress control brush 100 generate the feedback to the user so as to remind the user to stop brushing their teeth with enough brushing force to damage the teeth and the gums. The feedback to the user provided by the stress control brush 100 includes a force feedback, a sound feedback, or a deformation feedback. For example, during the deformation of the first protrusion part 1211 in the feedback component 120, the sudden change of the force feedback makes the user feel the sudden flexural deformation, the deformation of the first protrusion part 1211 generates the noise as a reminder, and continuously using the bent stress control brush 100 during the deformation of the first protrusion part 1211 is inconvenient.

When the user uses the tongue cleaning part (not shown in the figures) of the stress control brush 100 to clean the tongue, the brush head 110 bears a second force with a direction opposite to the direction of the first force F1, and the feedback component 120 is in the protruding state, the first protrusion part 1211 of the protrusion 121 is in the protruding state so that the second protrusion part 1212 is in contact with the first pressing part 114. At this time, the first limit part 113 keeps a distance from the second limit part 132, and the first pressing part 114 and the auxiliary limiting part 133 are pressed against each other.

With a significant pivot of the brush head 110 relative to the handle 130, once an angle between an extension line of the brush head 110 and an extension line of the handle 130 reaches a, the first limit part 113 having the extension direction toward the second limit part 132 presses against the second limit part 132 so as to stop the pivoting of the brush head 110 relative to the handle 130. Then the moving distance D of the second protrusion part 1212 toward the plane A (bottom surface 13411), where the sustaining parts 123 are located, cannot be increased anymore so as to prevent the first protrusion part 1211 of the feedback component 120 from overly sunken-deformation which generates an unrecoverable plastic deformation.

In addition, when the first limit part 113 and the second limit part 132 are pressed against each other, the user can apply a larger force to the brush head 110 for cleaning the particularly dirty parts of the teeth such as the residue between teeth without causing a situation where the stress control brush 100 is overly deformed and disabled use.

In addition, the critical elastic force of the feedback component 120 can be adjusted through the difference of the area, the thickness, the curvature of the protrusion, and the material. In the first embodiment of the present disclosure, the feedback component 120 is made of steel, the feedback component 120 has a disk shape, and the protrusion 121 has a circle shape, but the disclosure is not limited thereto. In other embodiments of the present disclosure, the protrusion can have an oval shape, a ball shape, or a rectangular shape, and the feedback component can be made of the polymer with high elastic coefficient or metals.

Figure 5A:
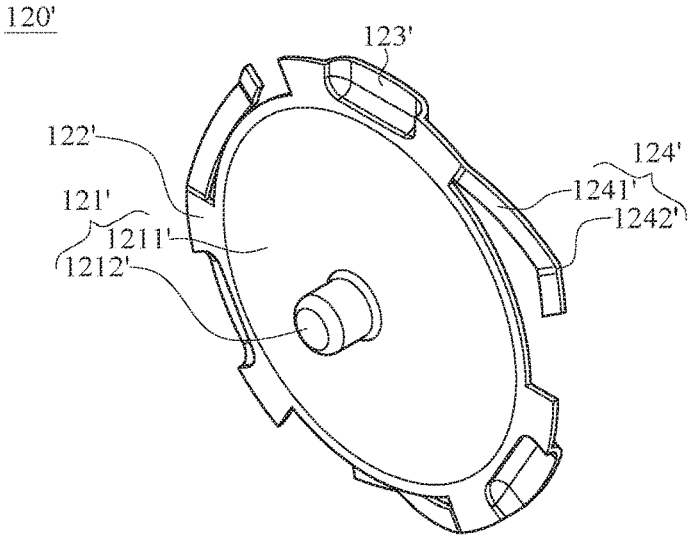
FIG. 5A is a schematic view of a second type feedback component in the first embodiment of the present disclosure.
Figure 5B:
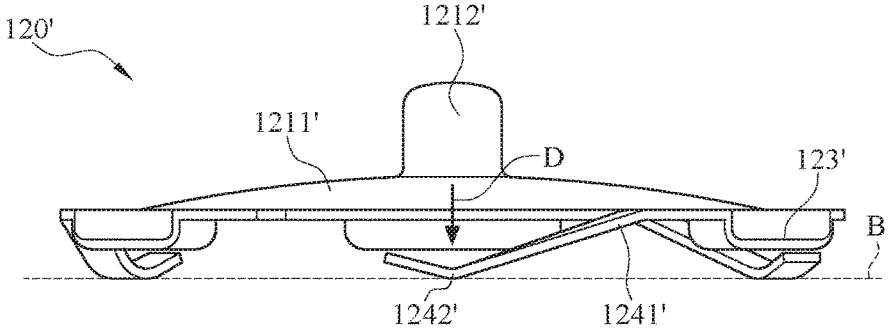
FIG. 5B is a side view of the second type feedback component in the first embodiment of the present disclosure.
Figure 5C:
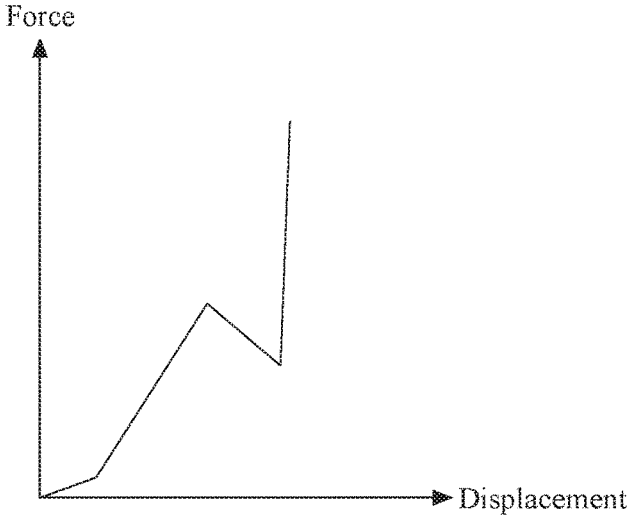
FIG. 5C is a schematic view of a force-displacement curve of the second type feedback component in the first embodiment of the present disclosure.

In the first embodiment of the present disclosure, the feedback component 120 is a first type feedback component, but the disclosure is not limited thereto. In other embodiments of the present disclosure, the feedback component can be a second type feedback component 120'. Please refer to FIG. 5A to FIG. 5C. FIG. 5A is a schematic view of a second type feedback component in the first embodiment of the present disclosure. FIG. 5B is a side view of the second type feedback component in the first embodiment of the present disclosure. FIG. 5C is a schematic view of a force-displacement curve of the second type feedback component in the first embodiment of the present disclosure. The second type feedback component 120' is similar to the first type feedback component 120, and the difference between the first type feedback component 120 and the second type feedback component 120' is that the second type feedback component 120' further includes three supporting parts 124'. Each of the three supporting parts 124' has a first end 1241' and a second end 1242' which are opposite to each other. Each of the first ends 1241' of the supporting parts 124' is connected to the side part 122'. Each of the second ends 1242' of the supporting parts 124' is extended toward a direction away from the first protrusion part 1211', the second protrusion part 1212', and the side part 122'. The extending direction of the second end 1242' is opposite to the protruding direction of the first protrusion part 1211' and the second protrusion part 1212'. Each of the supporting parts 124' is resilient so that the second end 1242' of the supporting part 124' can be moved close to or away from the side part 122'. In some embodiments of the present disclosure, the quantity of the supporting part 124' is three, but the disclosure is not limited thereto. In other embodiments of the present disclosure, the quantity of the supporting part can be one, two, or more than three. In some embodiments of the present disclosure, the extending direction of the second end 1242' is opposite to the protruding direction of the first protrusion part 1211' and the second protrusion part 1212', but the disclosure is not limited thereto. In other embodiments of the present disclosure, an obtuse angle is between the extending direction of the second end 1242' and the protruding direction of the first protrusion part 1211' and the second protrusion part 1212'.

Due to the influence of the structure of the first protrusion part 1211', the elastic coefficient of the first protrusion part 1211' is larger than the elastic coefficient of each of the supporting parts 124' and the total elastic coefficient of all the supporting parts 124'. As a result, the force applied on each of the supporting parts 124', to generate an elastic deformation, is smaller than the force applied on the first protrusion part 1211' to generate an elastic deformation. When the stress control brush 100 is in use, the second protrusion part 1212' of the second type feedback component 120' is pressed by the force, and the deformation starts from each of the supporting parts 124', and the moving distance D of the second protrusion part 1212 toward the plane B where the supporting parts 124' are located is increased. After the sustaining part 123' arrives at the plane B, the next is that the first protrusion part 1211' starts to deform so that the moving distance D is increased continuously.

Since the stress control brush is assembled by the brush head 110 and the handle 130, the distance between the first pressing part 114 of the brush head 110 and the bottom surface 13411 of the recess 1341 of the handle 130 has a tolerance. When the sum of the tolerance the distance between the first pressing part 114 of the brush head 110 and the bottom surface 13411 of the recess 1341 of the handle 130 is larger than the vertical distance between the second protrusion part 1212 and the plane A where the sustaining parts 123 are located, the first type feedback component 120 can move in the recess 1341 to generate an abnormal sound.

In contrast, in the second type feedback component 120', the supporting parts 124' are resilient and can be moved toward or away from the side part 122' so that the supporting parts 124' can fill the tolerance of the distance between the first pressing part 114 and the bottom surface 13411 of the recess 1341; therefore, the second protrusion part 1212' and the supporting parts 124' of the second type feedback component 120' are respectively kept in contact with the first pressing part 114 and the bottom surface 13411 of the recess 1341. As a result, the second type feedback component 120' cannot move in the recess 1341, and the abnormal sound is prevented.

In addition, in the first embodiment of the present disclosure, the feedback component 120 is located in the recess 1341 of the second pressing part 134, but the disclosure is not limited thereto. In one embodiment of the present disclosure, the feedback component is clamped between a surface of the first pressing part and a surface of the second pressing part which are facing each other.

Figure 6:
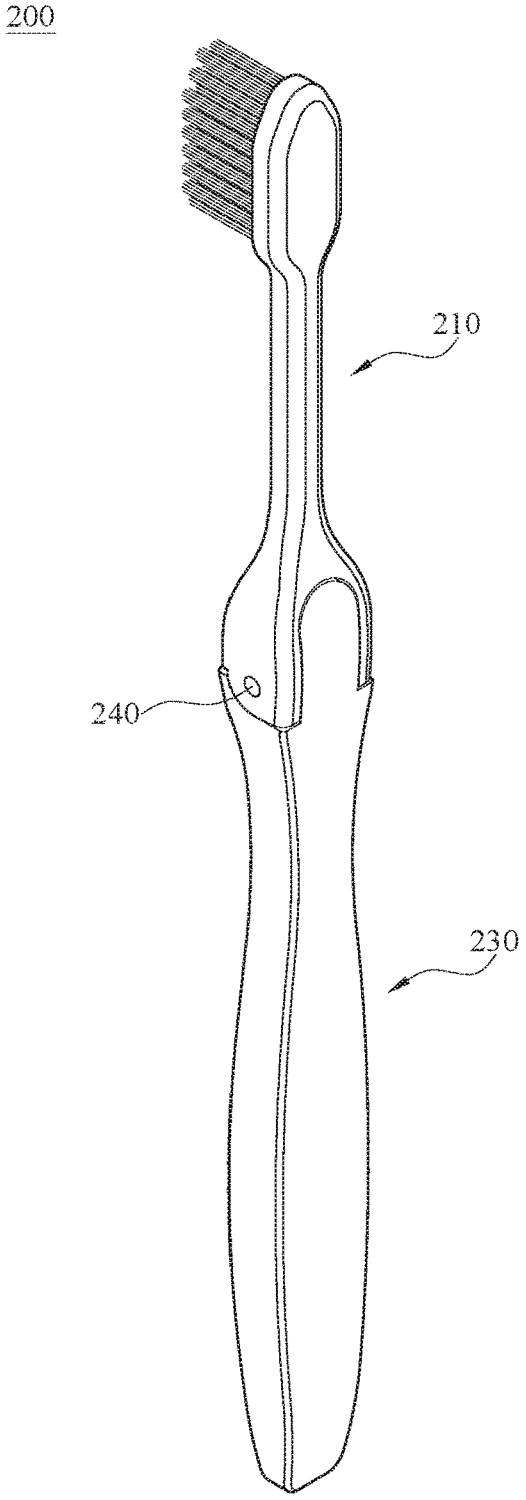
FIG. 6 is a schematic view of a stress control brush in a second embodiment of the present disclosure.
Figure 7:
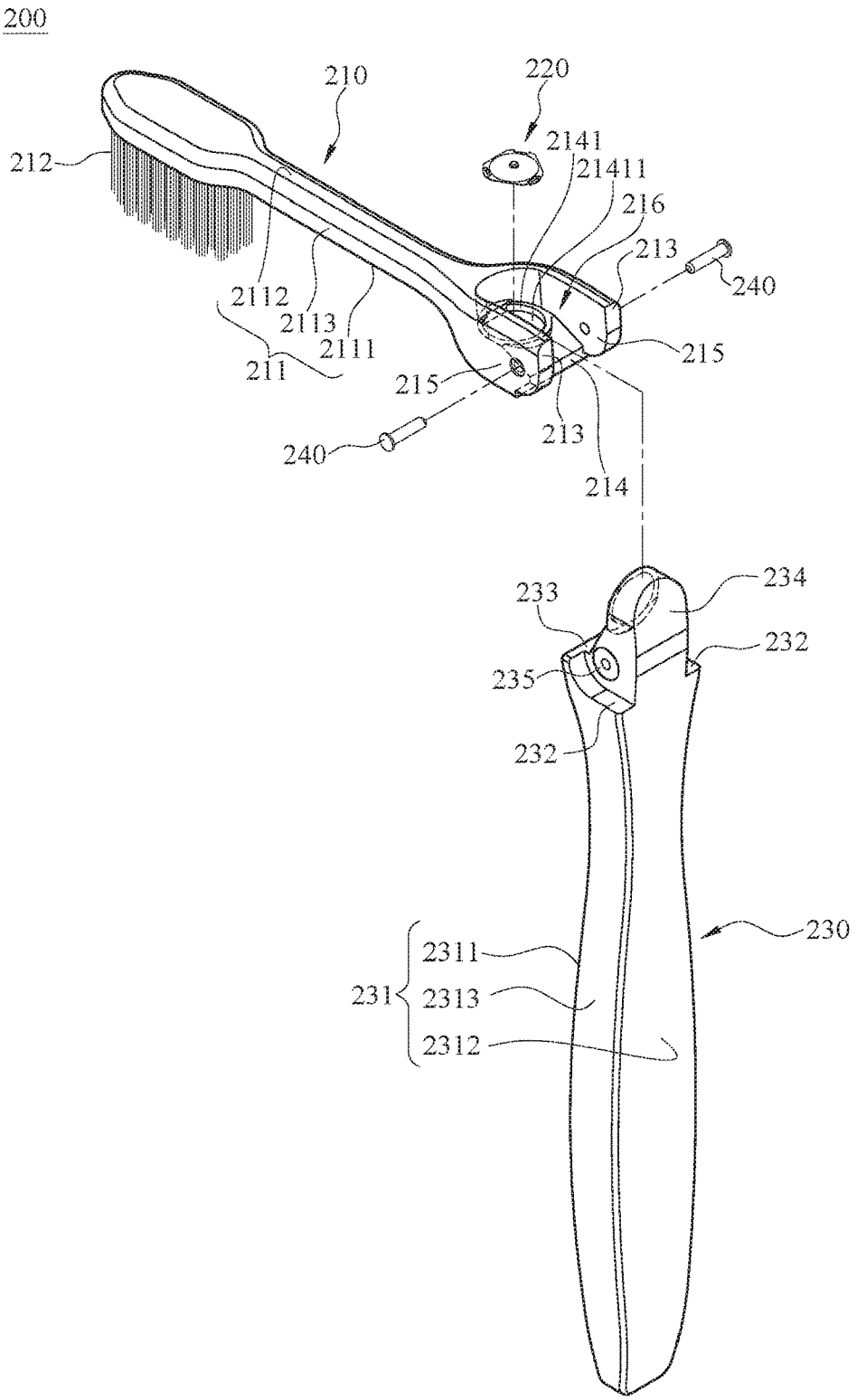
FIG. 7 is an exploded view of the stress control brush in the second embodiment of the present disclosure.
Figure 8:
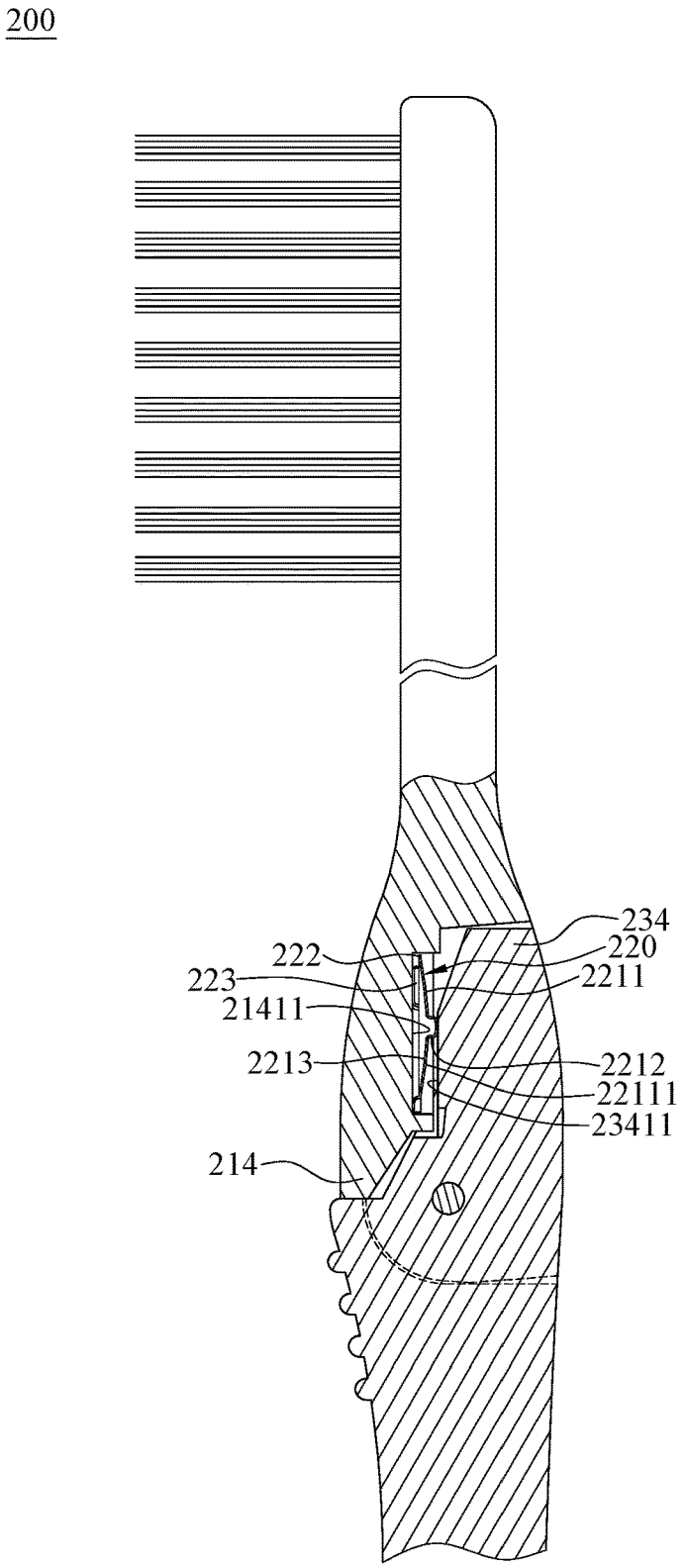
FIG. 8 is a cross-sectional view of the stress control brush in the second embodiment of the present disclosure.

Please refer to FIG. 6 to FIG. 8. FIG. 6 is a schematic view of a stress control brush in a second embodiment of the present disclosure. FIG. 7 is an exploded view of the stress control brush in the second embodiment of the present disclosure. FIG. 8 is a cross-sectional view of the stress control brush in the second embodiment of the present disclosure. The stress control brush in the second embodiment of the present disclosure is similar to the stress control brush in the first embodiment of the present disclosure, and the differences between the stress control brush in the second embodiment and the stress control brush in the first embodiment are explained herein, and the same structures thereof are not repeated herein.

The stress control brush 200 in the second embodiment of the present disclosure includes a brush head 210, a feedback component 220, a handle 230, and a pivoting component 240. The brush head 210 includes a bristle seat 211, a plurality of bristle bundles 212, two first limit parts 213, a first pressing part 214, and two first pivot parts 215. The bristle seat 211 has a front surface 2111 and a back surface 2112 which are opposite to each other, and two side surfaces 2113 which are opposite to each other and located between the front surface 2111 and the back surface 2112. The plurality of bristle bundles 212 is located at the front surface 2111. The two first limit parts 213 are respectively located at two ends of the back surface 2112 close to the two side surfaces 2113, and the two first limit parts 213 keep a distance between each other. The first pressing part 214 is located at the front surface 2111. A side of the first pressing part 214, facing the same direction with the back surface 2112, has a recess 2141. The recess 2141 has a bottom surface 21411. The two first pivot parts 215 are respectively located at two side surfaces 2113, and the two first pivot parts 215 keep a distance from each other. The two first limit parts 213, the first pressing part 214, and the two first pivot parts 215 form an accommodating space 216 together. In the second embodiment of the present disclosure, the bristle seat 211, the bristle bundles 212, the first limit part 213, the first pressing part 214, and the first pivot part 215 are made of polymer, and the bristle seat 211, the two first limit parts 213, the first pressing part 214, and the two first pivot parts 215 are integrally formed, but the disclosure is not limited thereto. In other embodiments of the present disclosure, the bristle seat, the two first limit parts, the first pressing part, and the two first pivot parts can be formed by assembling or in one piece.

The handle 230 includes a grip 231, two second limit parts 232, an auxiliary limiting part 233, a second pressing part 234, and a second pivot part 235. The grip 231 has a front surface 2311 and a back surface 2312 which are opposite to each other, and two side surfaces 2313 which are opposite to each other and located between the front surface 2311 and the back surface 2312. The two second limit parts 232 are respectively located at two ends of the back surface 2312 of the grip 231 close to the two side surface 2312 of the grip 231. The auxiliary limiting part 233 is located at the front surface 2311 of the grip 231. The second pivot part 235 connects the grip 231 and the second pressing part 234. The second pressing part 234 is a protrusion extending toward a direction away from the grip 231. In the second embodiment of the present disclosure, the grip 231, the second limit part 232, the auxiliary limiting part 233, the second pressing part 234, and the second pivot part 235 are made of polymer, and the grip 231, the second limit part 232, the auxiliary limiting part 233, the second pressing part 234, and the second pivot part 235 are integrally formed, but the disclosure is not limited thereto. In other embodiments of the present disclosure, the grip, the second limit part, the auxiliary limiting part, the second pressing part, and the second pivot part can be assembled or formed in one piece.

The feedback component 220 is located in the recess 2141 of the first pressing part 214. The sustaining parts 223 located at the side part 222 of the feedback component 220 are in contact with the bottom surface 21411 of the recess 2141. The first protrusion part 2211 and the second protrusion part 2212 of the feedback component 220 protrude toward a direction away from the bottom surface 21411 and are in contact with a side of the second pressing part 234 facing the first pressing part 214. In detail, as shown in FIG. 8, the handle 230 has a surface 23411, the brush head 210 has the bottom surface 21411 facing the surface 23411 of the handle 230, the feedback component 220 is installed between the surface 23411 and the bottom surface 21411, the feedback component 220 has a convex surface 22111 and a concave surface 2213 opposite each other, the convex surface 22111 faces one of the surface 23411 and the bottom surface 21411, and the concave surface 2213 faces the other one of the surface 23411 and the bottom surface 21411. In other embodiments of the present disclosure, the protrusion can include a first protrusion part where a concave region is located. The first pressing part can have a bulge facing the concave region on the first protrusion part. When the brush head pivots relative to the handle, the bulge protruding out from the first pressing part can press the first protrusion part at the concave region and further bring the first protrusion part to generate a sunken-deformation.

In the second embodiment of the present disclosure, the two first limit parts 213 and the first pressing part 214 are two pillars that respectively extend toward the second limit part 232 and the auxiliary limiting part 233 from the brush head 210. The two second limit parts 232 and the auxiliary limiting part 233 are surfaces of the handle 230, but the disclosure is not limited thereto. In other embodiments of the present disclosure, the second limit part and the auxiliary limiting part are stop blocks that protrude from the surface of the handle.

In addition, an opening (not shown in the figures) can be on the front surface 2111 and communicated with the accommodating space 216 so that the user can flush out the toothpaste foam from the accommodating space 216 with water. An elastic auxiliary bulge (not shown in the figures) is located at the front surface 2111, and the elastic auxiliary bulge protrudes toward and is in contact with the connecting area which connects the grip 231 and the second pressing part 234 so as to reduce the shake of brush head relative to the handle which is caused by manufacturing tolerance.

Figure 9:
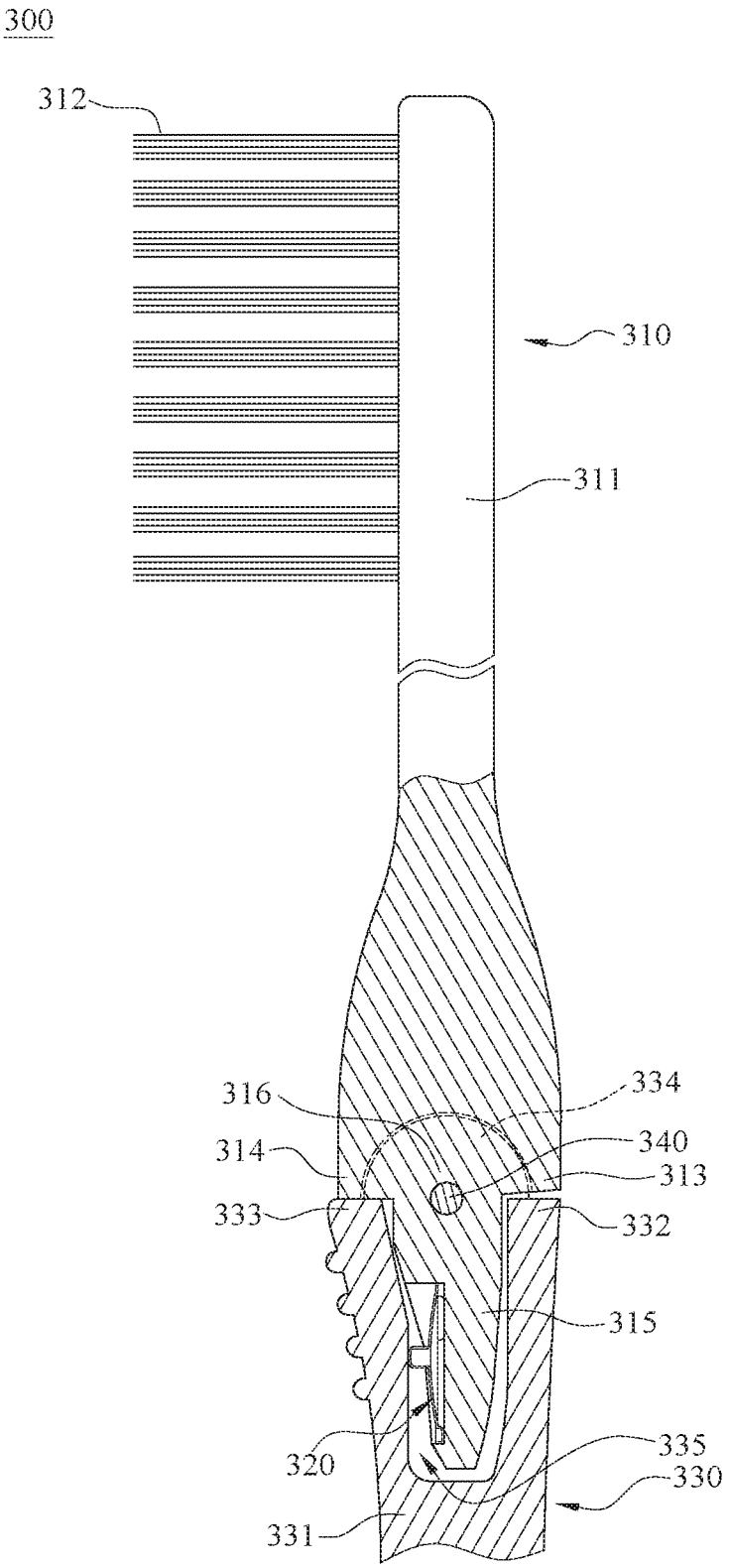
FIG. 9 is a cross-sectional view of a stress control brush in a third embodiment of the present disclosure.

Please refer to FIG. 9. FIG. 9 is a cross-sectional view of a stress control brush in a third embodiment of the present disclosure. The stress control brush in the third embodiment of the present disclosure is similar to the stress control brush in the first embodiment of the present disclosure. And the difference between the stress control brush in the third embodiment and the stress control brush in the first embodiment is that the locations of the pressing part and the limiting part of the brush head and the locations of the pressing part and the limiting part of the handle are respectively exchanged, and the same structures thereof are not repeated herein.

The stress control brush 300 in the third embodiment of the present disclosure includes a brush head 310, a feedback component 320, a handle 330, and a pivoting component 340. The brush head 310 includes a bristle seat 311, a plurality of bristles 312, a first limit part 313, a second limit part 314, a first pressing part 315, and a first pivot part 316. The handle 330 includes a grip 331, an auxiliary limiting part 332, a second pressing part 333, and two second pivot parts 334. The auxiliary limiting part 332, the second pressing part 333, and the two second pivot parts 334 together form an accommodating space 335.

The first pressing part 315 and the first pivot part 316 of the brush head 310 are located in the accommodating space 335 of the handle 330. The first pivot part 316 of the brush head 310 is pivoted between the two second pivot parts 334 of the handle 330 through the pivoting component 340 so that the brush head 310 is pivotable relative to the handle 330. As a result, the first pressing part 315, located in the accommodating space 335, can move close to or away from the second pressing part 333 so as to apply the force at the feedback component 320 located between the first pressing part 315 and the second pressing part 333. When the brush head 310 bears a first force F1 which is larger than the first critical force, the feedback component 320 bears a force larger than the critical elastic force and is in the breakdown-sunken state, and the first limit part 313 and the auxiliary limiting part 332 can press against each other when the brush head 310 is pivoted relative to the handle 330.

In the third embodiment of the present disclosure, the auxiliary limiting part 332 and the second pressing part 333 are pillars respectively extending toward the first limit part 313 and the second limit part 314 from the handle 330. The first limit part 313 and the second limit part 314 are surfaces of the brush head 310, but the disclosure is not limited thereto. In other embodiments of the present disclosure, the first limit part and the second limit part are stop blocks that protrude from the surface of the handle.

Figures 10A, 10B, 10C:
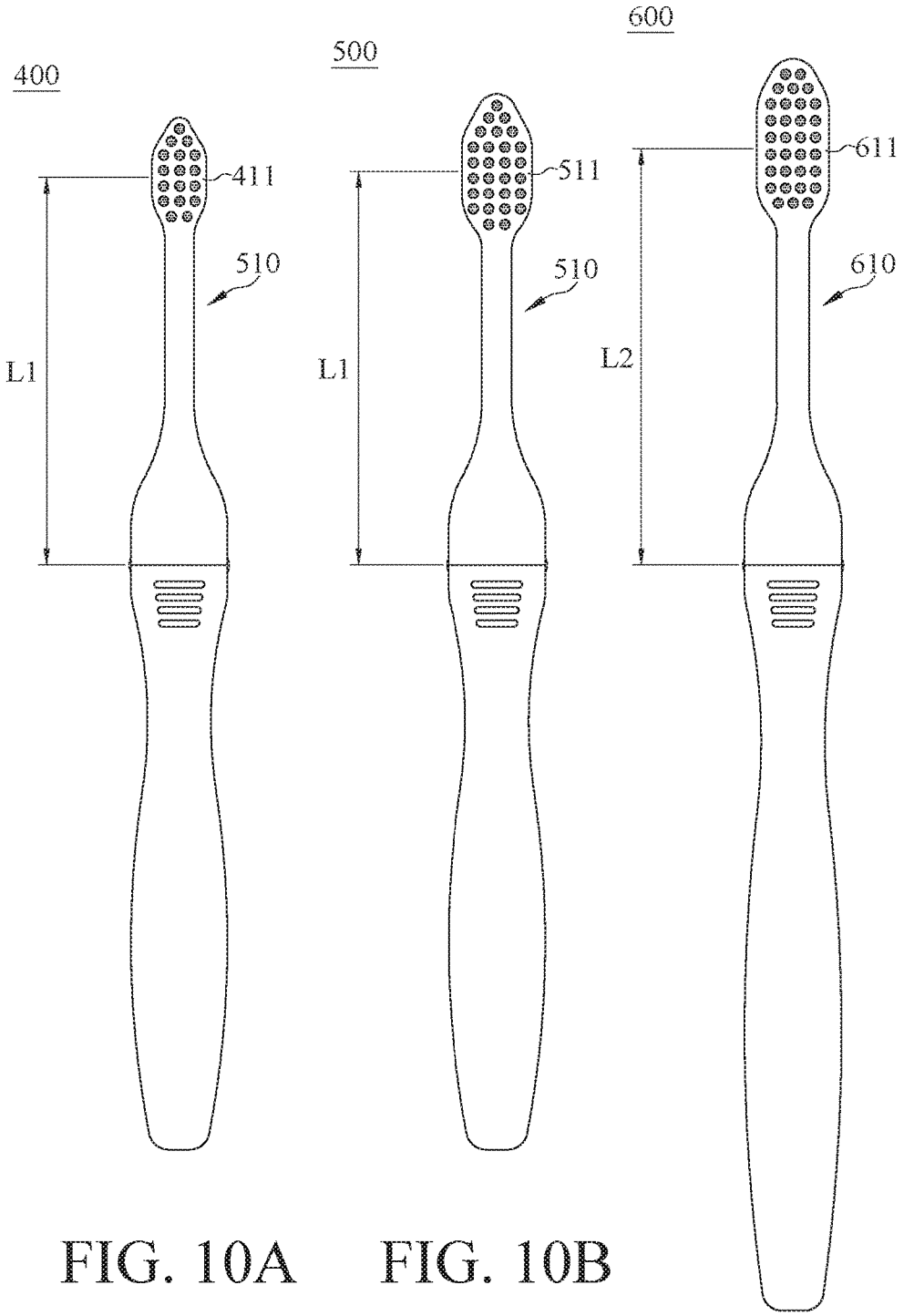
FIG. 10A to FIG. 10C are schematic views of stress control brushes in a fourth embodiment to a sixth embodiment of the present disclosure.

Please refer to FIG. 10A to FIG. 10C and table 1. FIG. 10A to FIG. 10C are schematic views of stress control brushes in a fourth embodiment to a sixth embodiment of the present disclosure. Table 1 shows the experiment data regarding to the quantity of the bristle bundles of the stress control brush, the length of the brush head, the critical elastic force of the feedback component, and other parameters in the some embodiments of the present disclosure. In table 1, the experiment data are the calculation results of bending a feedback component having a fixed size, wherein a situation that two teeth are in contact with 24 bristle bundles is assumed, the total pressure applied on the teeth is 150 g. Since the stress control brushes in the fourth embodiment to the sixth embodiment are similar to the stress control brush in the first embodiment, the differences between the stress control brush in the fourth embodiment to the sixth embodiment and the stress control brush in the first embodiment are explained herein, and the same structures thereof are not repeated herein.

In the stress control brush 400, the stress control brush 500, and the stress control brush 600 in the fourth embodiment to the sixth embodiment of the present disclosure, the quantity of the bristle bundles are 12 bundles, 20 bundles, and 24 bundles at a central region for installing the bristle bundles on the bristle seat 411 of the brush head 410, the bristle seat 511 of the brush head 510, and the bristle seat 611 of the brush head 610, respectively, but the disclosure is not limited thereto. In other embodiments of the present disclosure, the quantity of the bristle bundles at the central region can be any number except 12 bundles, 20 bundles, and 24 bundles. The force applied on the tooth by a single bristle bundle is constant. During the teeth brushing, when the quantity of the bristle bundles in contact with the teeth is increased, the counterforce applied on the brush head 410, the brush head 510, and the brush head 610 is increased. Generally, two teeth are in contact with the bristle bundles at the same time. Since the size of the permanent teeth, the deciduous teeth, and the oral cavities of adults and children are different. In order to let each user be able to choose a suitable stress control brush according to the size of the user's oral cavity and teeth, the size and the material of the feedback component is design to be adjusted according to the quantity of the bristle bundles on the brush head having a different size so as to obtain different critical elastic forces and make sure the teeth and gums of different users will not cause excessive tooth brushing force when the users brush their teeth with a suitable stress control brush.

In the stress control brush 400, the stress control brush 500, and the stress control brush 600 of the fourth embodiment to the sixth embodiment, the lengths from the central of the bristle bundle regions of the brush head 410, the brush head 510, and the brush head 610 to the pivoting component 440, the pivoting component 540, and the pivoting component 640, respectively, are L1, L1, and L2. In the fourth embodiment to the sixth embodiment of the present disclosure, L1 is 0.06 meters, L2 is 0.065 meters, but the disclosure is not limited thereto. In other embodiments of the present disclosure, the length between the center of the bristle bundle region to the pivoting component can be shorter than 0.06 meters and also can be longer than 0.065 meters. The size and the material of the feedback component is designed to be adjusted according to the different brush head lengths so as to obtain different critical elastic forces and make sure the teeth and gums of users will not apply excessive tooth brushing force when they brush their teeth with the stress control brush having a different brush head length. For example, when the user uses the stress control brush in contact with two teeth with the quantity of the bristle bundles being 24 bundles, and the length from the center of the bristle bundle region to the pivoting component is 0.056 meters, the feedback component in the stress control brush with a critical elastic force being 1.21875 kg is selected so as to avoid the teeth and gums bearing excessive force during tooth brushing.

TABLE 1

| | A | B | C |
|---|---|---|---|
| Quantity of bristle bundles in contact with two teeth (bundle) | 24 | 20 | 12 |
| Force applied by single bristle bundle (kg) | 0.00625 | 0.00625 | 0.00625 |
| Total pressure on two teeth (kgw/cm$^2$) | 0.15 | 0.125 | 0.075 |
| Length between the center of the bristle bundle region and the pivoting component (m) | 0.065 | 0.06 | 0.06 |
| Applying-force torque (kg · m) | 0.00975 | 0.0075 | 0.0045 |
| Length between the central point of the protruding part of the feedback component and the pivoting component (m) | 0.008 | 0.008 | 0.008 |
| Critical elastic force of the feedback component (kg) | 1.21875 | 0.9375 | 0.5625 |
| Resistance torque (kg · m) | 0.00975 | 0.0075 | 0.0045 |

According to the stress control brush of the present disclosure, when the user uses an appropriate force to brush teeth, the disk structure of the feedback component makes the elastic coefficient of the feedback component to be similar to the elastic component of a rigid body, and the deformation of the feedback component is pretty small. Once the user uses a force which can cause damage to the teeth and the gums, the feedback component is collapsed with the protrusion generating the elastically sunken-deformation so that the stress control brush also generates a significant deformation such as bending. The significant deformation of the stress control brush provides a feedback to the user so as to remind and stop the user from brushing their teeth with the brushing force capable of causing damage the teeth and gums. For example, the user feels a sudden flexural deformation or hears a noise when the user is using the stress control brush which notifies the user that the current brushing force can damage the teeth and gums.

Figure 11A:
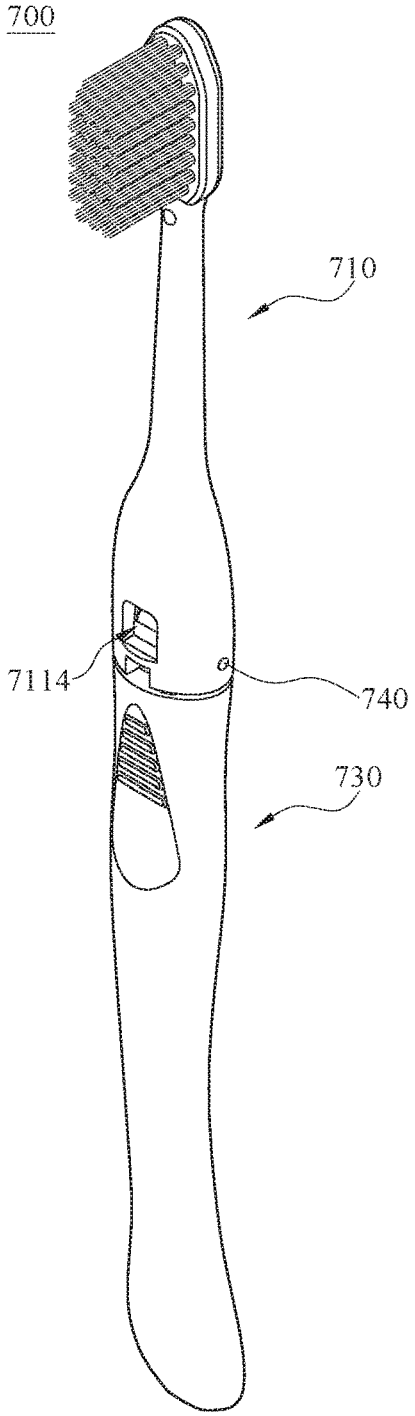
FIGS. 11A and 11B are schematic views of a stress control brush in a seventh embodiment of the present disclosure in different viewing angles.
Figure 11B:
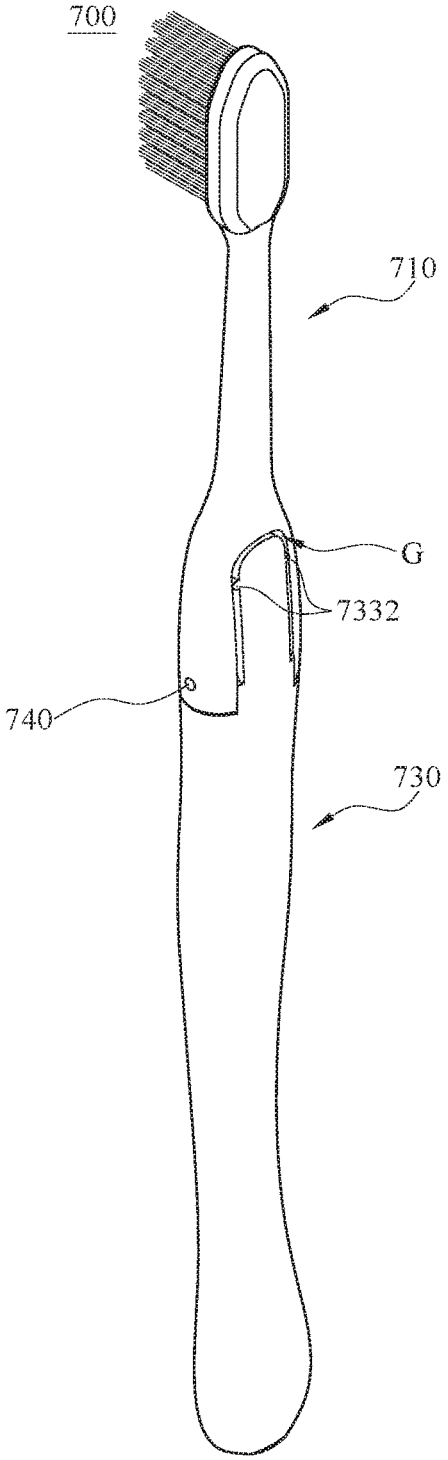
Figure 12A:
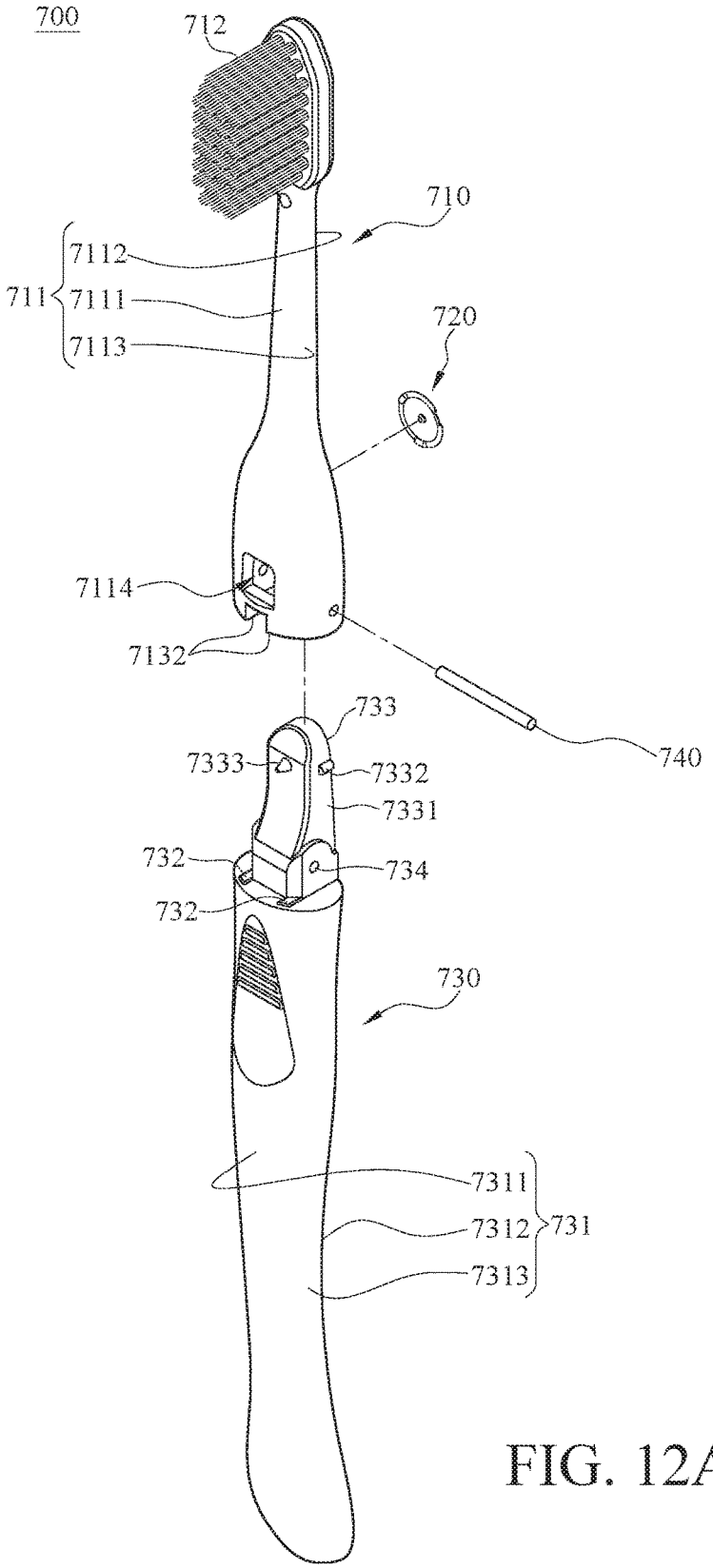
FIGS. 12A and 12B are exploded views of the stress control brush in the seventh embodiment of the present disclosure in different viewing angles.
Figures 12B, 12C:
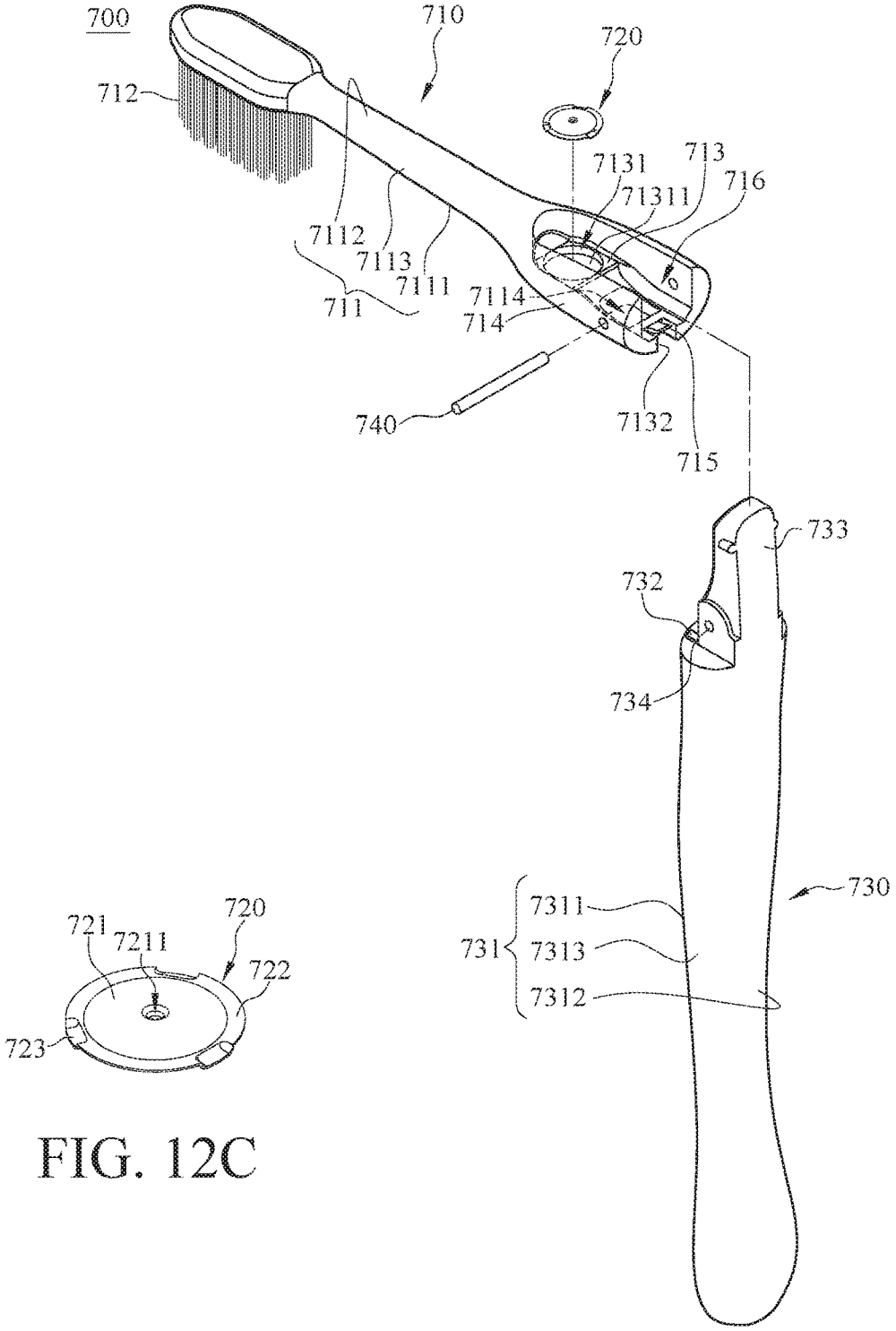
FIG. 12C is a schematic view of a feedback component in the seventh embodiment of the present disclosure.
Figure 13:
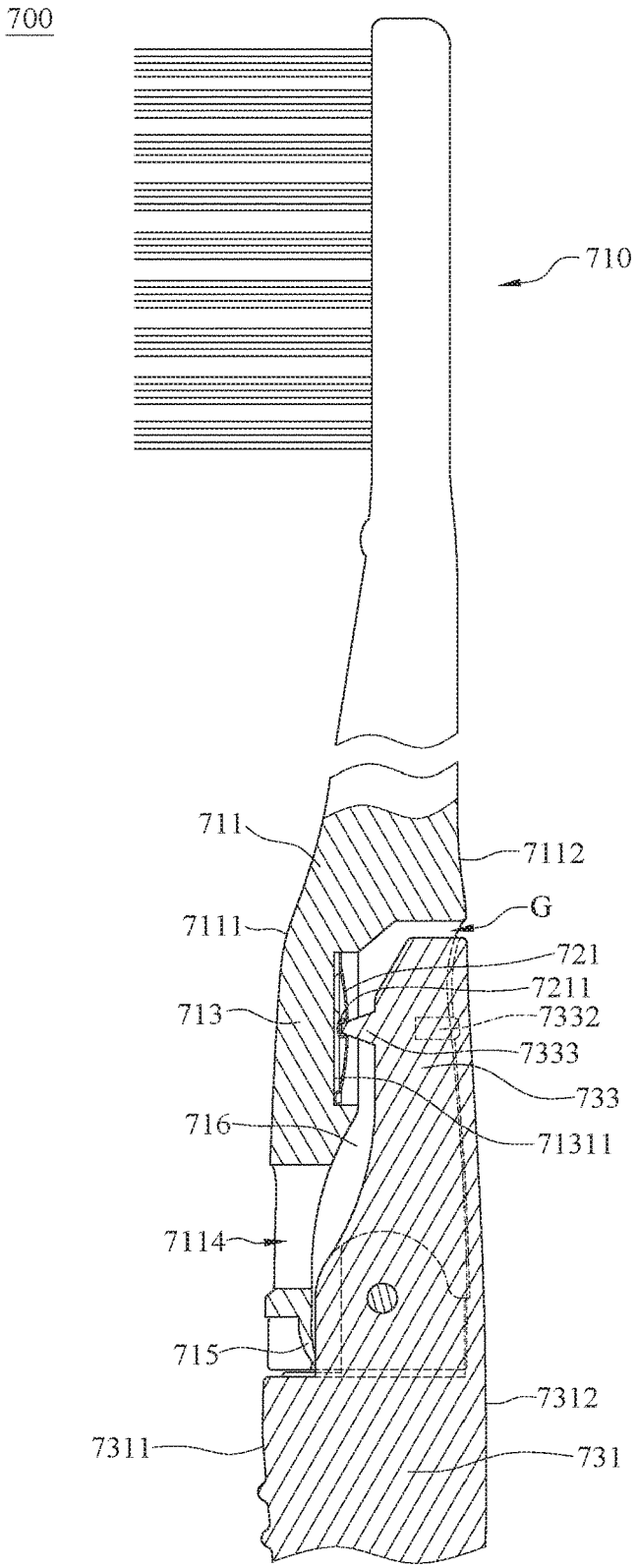
FIG. 13 is a cross-sectional view of the stress control brush in the seventh embodiment of the present disclosure.
Figure 14A:
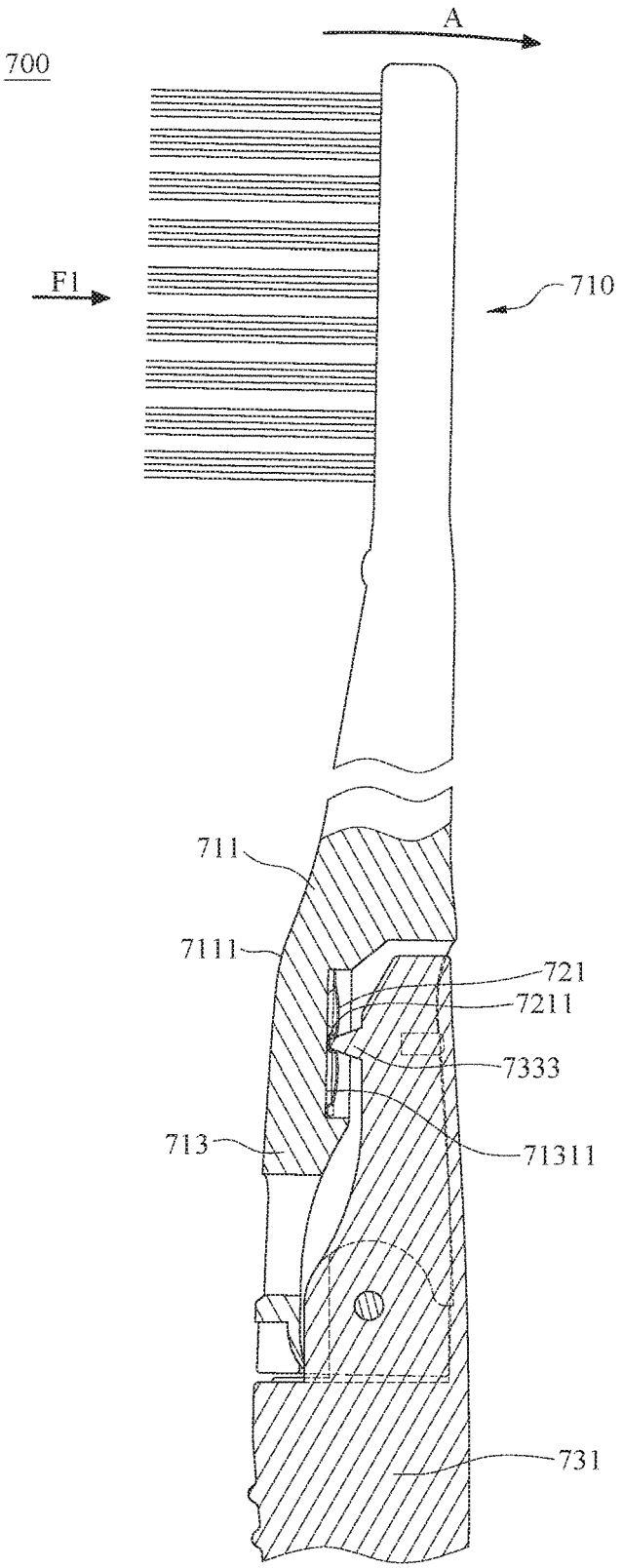
FIGS. 14A and 14B are cross-sectional view of the stress control brush in the seventh embodiment of the present disclosure in different pivot directions.
Figure 14B:
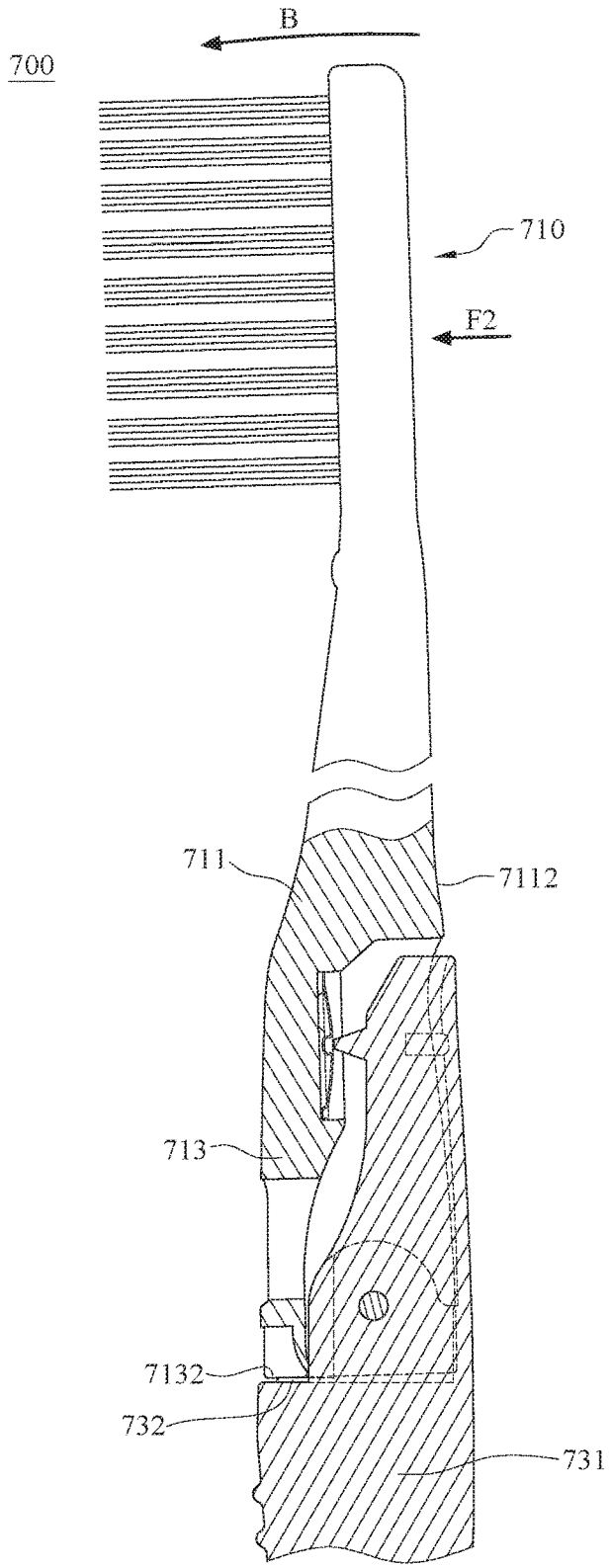

Please refer to FIG. 11A to FIG. 14B. FIGS. 11A and 11B are schematic views of a stress control brush in a seventh embodiment of the present disclosure in different viewing angles. FIGS. 12A and 12B are exploded views of the stress control brush in the seventh embodiment of the present disclosure in different viewing angles. FIG. 13 is a cross-sectional view of the stress control brush in the seventh embodiment of the present disclosure. FIGS. 14A and 14B are cross-sectional view of the stress control brush in the seventh embodiment of the present disclosure in different pivot directions. The stress control brush 700 in the seventh embodiment of the present disclosure is similar to the stress control brush 200 in the second embodiment of the present disclosure, and the differences between the stress control brush in the seventh embodiment and the stress control brush in the second embodiment are explained herein, and the same structures thereof are not repeated herein.

The stress control brush 700 in the seventh embodiment of the present disclosure includes a brush head 710, a feedback component 720, a handle 730, and a pivoting component 740. The brush head 710 includes a bristle seat 711, a plurality of bristle bundles 712, a first pressing part 713, two first pivot parts 714, and an elastic auxiliary bulge 715. The bristle seat 711 has a front surface 7111, a back surface 7112, two side surfaces 7113, and an opening 7114. The front surface 7111 and the back surface 7112 are opposite to each other. The two side surfaces 7113 are opposite to each other and located between the front surface 7111 and the back surface 7112. The plurality of bristle bundles 712 is located at the front surface 7111. The first pressing part 713 is located at the front surface 7111. A side of the first pressing part 713 facing the same direction with the back surface 7112 has a recess 7131. The recess 7131 has a bottom surface 71311. The two first pivot parts 714 are respectively located at two side surfaces 7113, and the two first pivot parts 714 keep a distance from each other. The first pressing part 713 and the two first pivot parts 714 form an accommodating space 716 together. The opening is on the front surface 7111 and communicated with the accommodating space 716 so that the user can flush out the toothpaste foam from the accommodating space 716 with water. The elastic auxiliary bulge 715 protrudes from the first pressing part 713.

In the seventh embodiment of the present disclosure, the bristle seat 711, the bristle bundles 712, the first pressing part 713, and the first pivot parts 714 are made of polymer, and the bristle seat 711, the first pressing part 713, and the two first pivot parts 714 are integrally formed, but the disclosure is not limited thereto. In other embodiments of the present disclosure, the bristle seat, the first pressing part, and the two first pivot parts can be assembled or formed in one piece.

The handle 730 includes a grip 731, an auxiliary limiting part 732, a second pressing part 733, and a second pivot part 734. The grip 731 has a front surface 7311 and a back surface 7312 which are opposite to each other, and two side surfaces 7313 which are opposite to each other and located between the front surface 7311 and the back surface 7312. The auxiliary limiting part 732 is located at the front surface 7311 of the grip 731. The second pivot part 734 connects the grip 731 and the second pressing part 733. The second pressing part 733 extends toward a direction away from the grip 731. Specifically, the second pressing part 733 extends into the accommodation space 716. The second pressing part 733 has an edge 7331, two auxiliary bulges 7332, and a pressing bulge 7333. The two auxiliary bulges 7332 protrude out from the edge 7331 and toward the two first pivot parts 714, respectively. The edge 7331 is a space apart from the two first pivot parts 714 so that a gap G, which is communicated with the accommodating space 716, is formed between the two first pivot parts 714 and the second pressing part 733. The gap G is also used for flushing out the toothpaste foam from the accommodating space 716 with water. The two auxiliary bulges 7332 are used for minimizing the shake of the bristle seat 712 relative to the grip 731 in the axial direction of the pivoting component 740.

In the seventh embodiment of the present disclosure, the grip 731, the auxiliary limiting part 732, the second pressing part 733, and the second pivot part 734 are made of polymer, and the grip 731, the auxiliary limiting part 732, the second pressing part 733, and the second pivot part 734 are integrally formed, but the disclosure is not limited thereto. In other embodiments of the present disclosure, the grip, the second limit part, the auxiliary limiting part, the second pressing part, and the second pivot part can be formed by assembling or in one piece. In the seventh embodiment of the present disclosure, the second pressing part 733 has two auxiliary bulges 7332, but the disclosure is not limited thereto. In other embodiments of the present disclosure, the second pressing part 733 has no auxiliary bulge.

The elastic auxiliary bulge 715 is located at the front surface 7111, and the elastic auxiliary bulge 715 protrudes toward and abuts against the second pivot part 734. Therefore, the shake of brush head relative to the handle, which is caused by manufacturing tolerance, is reduced by the elastic auxiliary bulge 715.

The feedback component 720 is located in the recess 7131 of the first pressing part 713. The sustaining parts 723 located at the side part 722 of the feedback component 720 are in contact with the bottom surface 71311 of the recess 7131. The protrusion 721 of the feedback component 720 protrudes toward a direction away from the bottom surface 71311. The protrusion 721 has a concave 7211 located at a surface of the protrusion 721 away from the bottom surface 71311. The location of the concave 7211 corresponds to the bulge 7333 of the second pressing part 733. In the seventh embodiment of the present disclosure, the protrusion 721 has a concave 7211, but the disclosure is not limited thereto. In other embodiments of the present disclosure, the protrusion has no concave 7211.

When the first force F1, greater than a critical force, is applied to the brush head 710 along a direction toward the front surface 7111, the bristle seat 711 is pivoted relative to the grip 731 in a direction A, the bulge 7333 presses the protrusion 721 at the concave 72111 and brings the protrusion 721 to generate a sunken-deformation. When the deformed protrusion 721 touches the bottom surface 71311, the movement of the protrusion 721 and the bulge 7333 are restricted so as to restrict the pivotable angle between the bristle seat 711 and the grip 731 in the direction A.

When the second force F2 is applied to the brush head 710 along a direction toward the back surface 7112, the bristle seat 711 is pivoted relative to the grip 731 in a direction B which is opposite to the direction A, an edge 7132 of the first pressing part 713 and the auxiliary limiting part 732 are abut against each other to restrict the pivotable angle between the bristle seat 711 and the grip 731 in the direction B. The auxiliary limiting part 732 is stop blocks protruding from the surface of the handle 730, but the disclosure is not limited thereto. In other embodiments of the present disclosure, the auxiliary limiting part is a surface of the handle.

In addition, the feedback component in the stress control brush of the present disclosure has a protrusion structure so that the elastic coefficient of the feedback component is significantly higher than the elastic coefficient of the conventional curved feedback component. As a result, when the user brushes teeth with the brushing force smaller than the critical force, the deformation of the stress control brush in the present disclosure is much smaller than the deformation of the brush with the curved feedback component. Once the user brushes teeth with the brushing force larger than the critical force, the feeling of a sudden flexural deformation as the feedback generated by the stress control brush in the present disclosure is significantly higher than the frustrated feeling generated by the brush with curved feedback component so that the feedback effect of the stress control brush in the present disclosure is significantly improved In addition, when the brush head of the stress control brush in the present disclosure bears a brushing force larger than the first critical force, the brush head is pivoted relative to the handle so that the first limit part and the second limit part are pressed against each other to stop the brush head to pivot relative to the handle and the overly sunken-deformation of the protrusion of the feedback component which generates an unrecoverable plastic deformation and breaks the stress control function of the brush.

In addition, when the stress control brush in the present disclosure is in use, the mechanism, which the force is directly transmitted to the protrusion of the feedback component in contact with the brush head through the brush head, can avoid the loss of the force during the transmittance by passing to many movable component so that the value of forces which cause the deformations each time can be consistent for improving the stress control effort.

In addition, in the stress control brush of the present disclosure, when the first limit part and the second limit part are pressed against each other, the user can apply a larger force to the brush head for cleaning the particularly dirty parts of the teeth such as, residue between teeth, without a situation where the stress control brush is overly deformed and disabled to use.

In addition, in the present disclosure, the first limit part is located at the outside of the brush head, and the second limit part is located at the outside of the handle, and the pivot structure is located at the outside of the oral cavity during teeth brushing; therefore, the residues and the contaminants in the oral cavity have difficulty getting into the pivot structure, and there are few gaps where the contaminants can easily collect, and the brush is easy to be cleaned and kept dry, while avoiding the residues and the contaminants breading bacteria in the humid environment and generating a hygiene issue regarding to increasing the possibility of infection.

What is claimed is:

1. A stress control brush, comprising:

a handle;

a brush head pivoted on the handle, and the brush head being pivotable relative to the handle in an angular range, wherein the handle has a first surface, the brush head has a second surface facing the first surface; and a feedback component installed between the first surface of the handle and the second surface of the brush head and having a convex surface and a concave surface opposite each other, the convex surface facing one of the first surface and the second surface, and the concave surface facing the other one of the first surface and the second surface, the feedback component being resilient and having a protruding state and a breakdown-sunken state;

wherein, when the brush head is pivoted relative to the handle, the feedback component is pressed by the brush head and the handle so as to be in the breakdown-sunken state, and a feedback is provided by the feedback component.

2. The stress control brush according to claim 1, wherein one of the handle and the brush head has a protrusion, and the other one of the handle and the brush head has an accommodating space, and the protrusion is located in the accommodating space.

3. The stress control brush according to claim 2, wherein the brush head comprises a bristle seat, at least one first limit part and a first pressing part, the at least one first limit part and the first pressing part are connected to and protrude from a side of the bristle seat to form an accommodating space therebetween, the handle comprises a grip, at least one second limit part and a second pressing part, the at least one second limit part is connected to the grip, the second pressing part protrudes from the handle and is located in the accommodating space; when the feedback component is in the breakdown-sunken state, the at least one first limit part and the at least one second limit part are abutted against each other for limiting the angular range of the brush head.

4. The stress control brush according to claim 3, wherein the second pressing part is located between the first pressing part and the at least one limiting part, and the feedback component is clamped between the first pressing part and the second pressing part, when the brush head is pivoted relative to the handle, the first pressing part and the second pressing part press the feedback component.

5. The stress control brush according to claim 3, wherein a quantity of the at least one first limiting part is two, the two first limiting parts are located at a side of the first pressing part, the second pressing part are located between the two first limiting parts, and the feedback component is clamped between the first pressing part and the second pressing part.

6. The stress control brush according to claim 3, wherein the first pressing part or the second pressing part has a recess, and the feedback component is located in the recess.

7. The stress control brush according to claim 3, wherein the brush head further comprises a plurality of bristle bundles, the bristle seat has a front surface and a back surface which are opposite to each other, the plurality of bristle bundles are located on the front surface, and the feedback component is in the breakdown-sunken state when a first force greater than a critical force is applied to the brush head along a direction toward the front surface.

8. The stress control brush according to claim 7, wherein the handle further comprises an auxiliary limiting part connected to the grip, when a second force is applied to the brush head along a direction toward the back surface, the first pressing part and the auxiliary limiting part are abutted against each other for limiting the angular range of the brush head.

9. The stress control brush according to claim 1, wherein the brush head comprises a bristle seat and a first pressing part, the first pressing part is connected to the bristle seat, the handle comprises a grip and a second pressing part, the second pressing part is connected to the grip, the bristle seat is pivotable relative to the grip, the first pressing part protrudes from the bristle seat and extends toward the grip, the second pressing part protrudes from the grip and extends toward the bristle seat, the first pressing part and the second pressing part are intersected with each other, the feedback component is clamped between the first pressing part and the second pressing part, when the brush head is pivoted relative to the handle, the feedback component is pressed by the first pressing part and the second pressing part.

10. The stress control brush according to claim 9, wherein the brush head further comprises a plurality of bristle bundles, the bristle seat has a front surface and a back surface which are opposite to each other, the plurality of bristle bundles are located on the front surface, and the feedback component is in the breakdown-sunken state when a first force greater than a critical force is applied to the brush head along a direction toward the front surface.

11. The stress control brush according to claim 10, wherein the feedback component comprises a protrusion part, when the feedback component clamped between the first pressing part and the second pressing part is in the breakdown-sunken state, the first pressing part is abutted against the second pressing part through the protrusion part for limiting a pivotable angle between the brush head and the handle.

12. The stress control brush according to claim 10, wherein the handle further comprises an auxiliary limiting part connected to the grip, when a second force is applied to the brush head along a direction toward the back surface, the first pressing part and the auxiliary limiting part are abutted against each other so as to limit the pivotable angle between the brush head and the handle.

13. The stress control brush according to claim 9, wherein the first pressing part has a recess, and the feedback component is located in the recess.

14. The stress control brush according to claim 9, wherein the brush head further comprises two first pivot part, the two first pivot parts protrude out of the bristle seat, the first pressing part is located between the two first pivot parts, the handle further comprises a second pivot part, the grip and the second pressing part are connected by the second pivot part, and the two first pivot parts are pivoted to the second pivot part.

15. The stress control brush according to claim 14, wherein the brush head has an accommodating space and an opening, the accommodating space is formed by the first pressing part and the two first pivot parts, and the opening is on the first pressing part and communicated with the accommodating space.

16. The stress control brush according to claim 14, wherein the brush head further comprises an elastic auxiliary bulge located at the bristle seat, the elastic auxiliary bulge protrudes toward and in contact with the second pivot part.

17. The stress control brush according to claim 1, wherein the feedback component has a concave located on the convex surface, and the handle comprises a pressing bulge corresponding to the bulge; when the feedback component is in the breakdown-sunken state, the bulge presses the concave.

18. The stress control brush according to claim 1, wherein the feedback component further comprises a protrusion, the protrusion comprises a first protrusion part and s second protrusion part, and the second protrusion part protrudes out of the first protrusion part.

19. The stress control brush according to claim 1, wherein the brush head is pivotably connected to the handle by at least one pivoting component.

20. The stress control brush according to claim 1, wherein the feedback includes a force feedback, a sound feedback, or a deformation feedback.

* * * * *